US009567158B2

(12) United States Patent
Bennett et al.

(10) Patent No.: US 9,567,158 B2
(45) **Date of Patent: *Feb. 14, 2017**

(54) DUAL RECYCLABLES AND NON-RECYCLABLE WASTE COLLECTION DEVICE AND METHOD THEREFOR

(71) Applicant: Hybrid Containers, LLC, Gilbert, AZ (US)

(72) Inventors: David Bennett, Gilbert, AZ (US); James A. Spahn, Gilbert, AZ (US); Steven D. Veatch, Tempe, AZ (US)

(73) Assignee: Hybrid Containers, LLC, Gilbert, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/065,100

(22) Filed: Oct. 28, 2013

(65) Prior Publication Data

US 2015/0118005 A1 Apr. 30, 2015

(51) Int. Cl.

| | |
|---|---|
| ***A47G 19/00*** | (2006.01) |
| ***B65F 1/12*** | (2006.01) |
| ***B65F 1/14*** | (2006.01) |
| *B65F 1/00* | (2006.01) |

(52) U.S. Cl.

CPC ..... *B65F 1/122* (2013.01); *B65F 1/1615* (2013.01); *B65F 2001/0086* (2013.01)

(58) Field of Classification Search

CPC ..... Y10S 220/909; B65F 1/122; B65F 1/004; B65F 3/001

USPC ..... 220/524, 4.03, 4.26, 4.31, 4.33, 23.2,220/23.4, 23.83, 23.86, 502, 505, 908, 909, 1.5,220/2; 206/499, 504; 414/406–410, 411, 414; 294/68.1–68.3

See application file for complete search history.

(56) References Cited

U.S. PATENT DOCUMENTS

| | | | | |
|---|---|---|---|---|
| 2,606,675 | A * | 8/1952 | Jones | 220/23.83 |
| 3,823,972 | A * | 7/1974 | Ramer | 294/68.26 |
| 3,862,973 | A * | 1/1975 | Dietrich et al. | 560/335 |
| 4,290,352 | A * | 9/1981 | Schmidt et al. | 100/100 |
| 4,913,301 | A * | 4/1990 | Pickler | 414/403 |
| 5,092,480 | A * | 3/1992 | Waterston | 220/23.4 |
| 5,213,382 | A * | 5/1993 | Dawdy et al. | 292/228 |
| 5,222,619 | A * | 6/1993 | Gregory | 220/324 |
| 5,547,097 | A * | 8/1996 | Lyon | 220/23.83 |
| 6,042,238 | A * | 3/2000 | Blackham et al. | 353/94 |

* cited by examiner

*Primary Examiner* — Shawn M Braden
(74) *Attorney, Agent, or Firm* — Booth Udall Fuller, PLC

(57) ABSTRACT

A device for commercial waste collection has a first container and a second container. A lid covers the first container. A first pair of lifting sleeves is attached to side surfaces of the first container for lifting the first container. A second pair of lifting sleeves is attached to side surfaces of the second container and positioned below the first pair of lifting sleeves. A third pair of lifting sleeves is attached to the side surfaces of the first container and aligned with the second pair of lifting sleeves. The second pair of lifting sleeves and the third pair of lifting sleeves are used together to lift both the first container and the second container together. A latching mechanism is provided for preventing opening of the lid when lifting both the first container and the second container together.

7 Claims, 41 Drawing Sheets

DUAL RECYCLABLES AND NON-RECYCLABLE WASTE COLLECTION DEVICE AND METHOD THEREFOR

RELATED APPLICATIONS

The present application is a divisional of U.S. Patent Application entitled "Dual Recycling and Non-Recyclable Waste Collection Device and Method", having Ser. No. 12/419,968, and a filing date of Apr. 7, 2009, and in the name of the same inventors.

FIELD OF THE INVENTION

The present invention relates to waste collection; and more specifically, to a dumpster-like device that integrates a container for non-recyclable waste and a container for recyclables within the same space provided by current single-dumpster areas and enclosures; and, provides a method for the separate collection of the contents of each of the two containers using existing industry-standard waste removal vehicles and facilities.

BACKGROUND OF THE INVENTION

Recycling programs are beneficial for many reasons. For example: 1) Many American companies rely on recycling programs to provide the raw materials they need to make new products. Recycling in the U.S. is a $236 billion a year industry. 2) More than 56,000 recycling and reuse enterprises employ 1.1 million workers nationwide. 3) The average American business discards one hundred pounds of garbage every day. Most of this garbage goes into landfills, where it's compacted and buried. 4) Recycling requires far less energy, uses fewer natural resources, and keeps waste from piling up in landfills. 5) Recycling offers significant energy savings over manufacturing with virgin materials. For example, manufacturing with recycled aluminum cans uses 95% less energy. 6) Recycling preserves existing landfill space. 7) In 2000, recycling of solid waste prevented the release of 32.9 million metric tons of carbon equivalent (MMTCE, the unit of measure for greenhouse gases) into the air. 8) Making goods from recycled materials generates far less water pollution than manufacturing from virgin materials. 9) Using recycled materials reduces the need to damage forests, wetlands, rivers and other places essential to wildlife. 10) Recycling and buying recycled products creates demand for more recycled products, decreasing waste and helping our economy.

However, much of the current infrastructure for commercial bulk waste collection does not provide the option of a single bulk collection area for placement of both recyclables and non-recyclable waste containers. Furthermore, many waste collection trucks are not equipped to handle both recyclables and non-recyclable waste containers as the two different containers generally require different mechanisms to allow the waste collection trucks to lift, hold and empty the different containers. Accordingly, when a municipality is forced to choose which type of garbage to collect in a given commercial bulk location, the collection of recyclables is either made more expensive, made less convenient or simply removed altogether.

Therefore, a need exists to provide a device and method to overcome the above problems. A solution is to provide a device that integrates a container for non-recyclable waste, a container for recyclables, and a means for the separate collection of the contents of the two containers using a standard fork lift-operated garbage truck. This device and method of removal allows the truck operator to selectively collect either waste or recycling based solely on the position of the forks.

SUMMARY OF THE INVENTION

In accordance with one embodiment, a device and method for waste collection is disclosed. The device for waste collection has a first container and a second container. A lid covers the first container. A first pair of lifting sleeves is attached to side surfaces of the first container for lifting the first container. A second pair of lifting sleeves is attached to side surfaces of the second container and positioned below the first pair of lifting sleeves. A third pair of lifting sleeves is attached to the side surfaces of the first container and aligned with the second pair of lifting sleeves. The second pair of lifting sleeves and the third pair of lifting sleeves are used together to lift both the first container and the second container together. A latching mechanism is provided for preventing opening of the lid when lifting both the first container and the second container together.

In accordance with another embodiment of the present invention, a device and method for waste collection is disclosed. The device for waste collection has a first container and a second container. A lid covers the second container. A first pair of lifting sleeves is attached to side surfaces of the first container. A second pair of lifting sleeves is attached to side surfaces of the second container and positioned above the first pair of lifting sleeves for lifting the second container individually. A third pair of lifting sleeves is attached to the side surfaces of the second container and aligned with the first pair of lifting sleeves, the first pair of lifting sleeves and the third pair of lifting sleeves are used together to lift both the first container and the second container together. A latching mechanism is used for preventing opening of the lid when lifting both the first container and the second container together.

In another embodiment of the present invention, a device and method for waste collection is disclosed. The device for waste collection has a first container and a second container. A first pair of lifting sleeves is formed on side surfaces of the first container for lifting the first container. A second pair of lifting sleeves is formed on side surfaces of the second container and positioned below the first pair of lifting sleeves for lifting the second container.

In yet another embodiment of the device, a device and method for waste collection is disclosed. The device for waste collection has a first container and a second container. A lid covers the first container. A first pair of lifting sleeves is attached to side surface of the first container and extending away from the first container for lifting the first container. The first pair of lifting sleeves extending away from the first container used to align the first container and the second container. A second pair of lifting sleeves is attached to side surfaces of the second container and positioned below the first pair of lifting sleeves. A securing mechanism is used to lock the first container and the second container together when the first container and the second container are lifted together. A latching mechanism is used to prevent opening of the lid when lifting both the first container and the second container together.

In accordance with yet another embodiment, a device and method for waste collection is disclosed. The device and method has a first compartment and a second compartment. A first pair of lifting sleeves is formed on bottom surface of the first compartment. A second pair of lifting sleeves is formed on a bottom surface of the second compartment and aligned with the first pair of lifting sleeves. The first pair of lifting sleeves and the second pair of lifting sleeves are used to lift both the first container and second container together. A third pair of sleeves is formed on the bottom surface of the second compartment and positioned next to the second pair of sleeves for individually lifting the second compartment.

The features, functions, and advantages can be achieved independently in various embodiments of the disclosure or may be combined in yet other embodiments.

BRIEF DESCRIPTION OF THE DRAWINGS

Embodiments of the disclosure will become more fully understood from the detailed description and the accompanying drawings, wherein.

DETAILED DESCRIPTION OF THE PREFERRED EMBODIMENTS

Figure 1A:
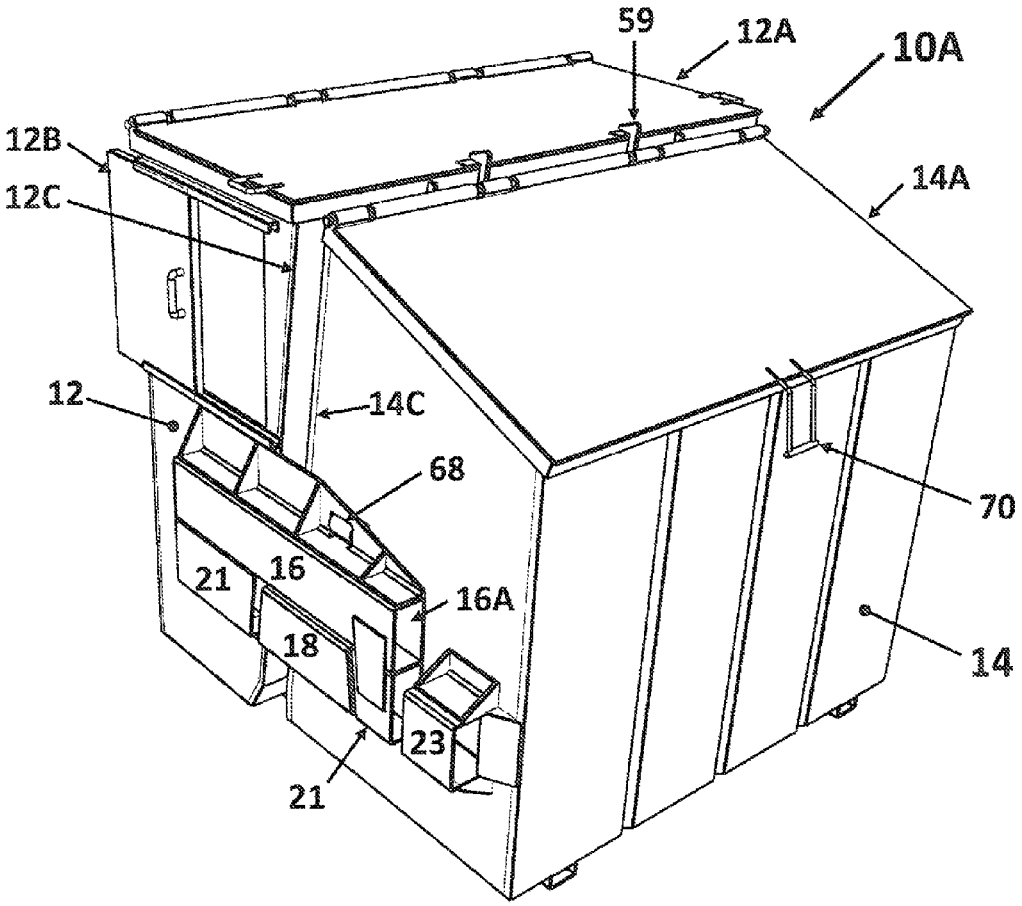
FIG. 1A is a elevated perspective view of one embodiment of the device of the present invention.
Figure 1B:
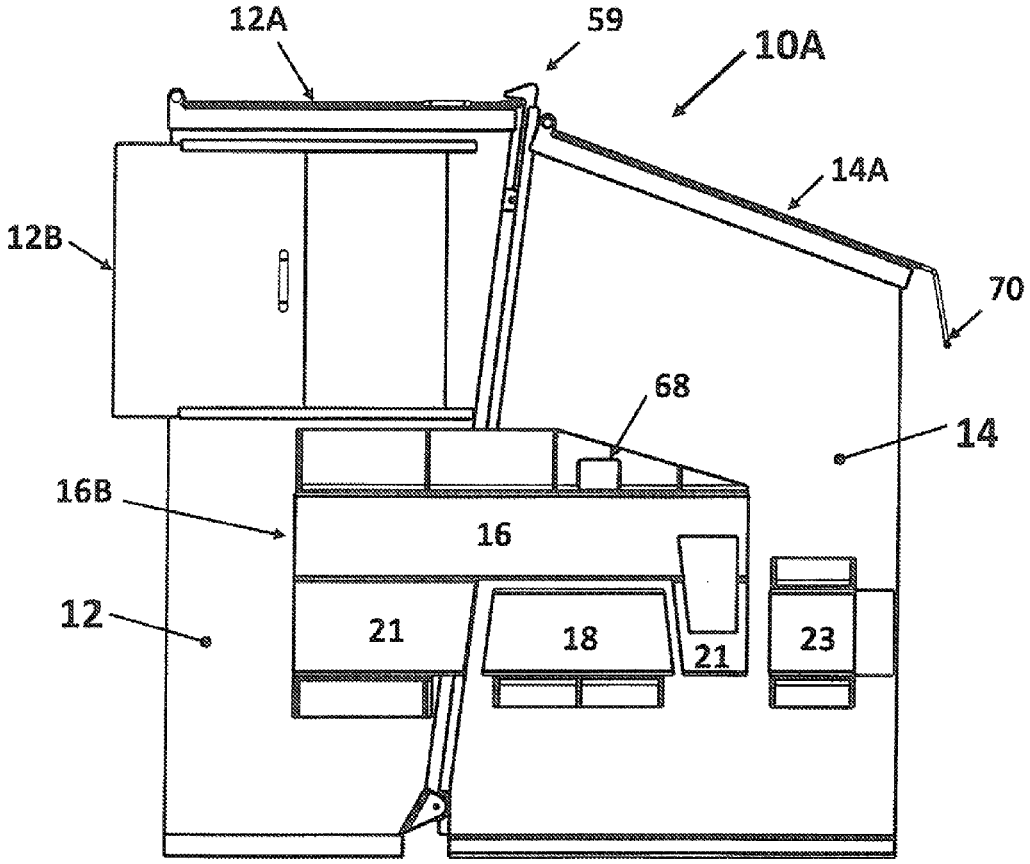
FIG. 1B is a side view of the device of FIG. 1A.
Figure 1C:
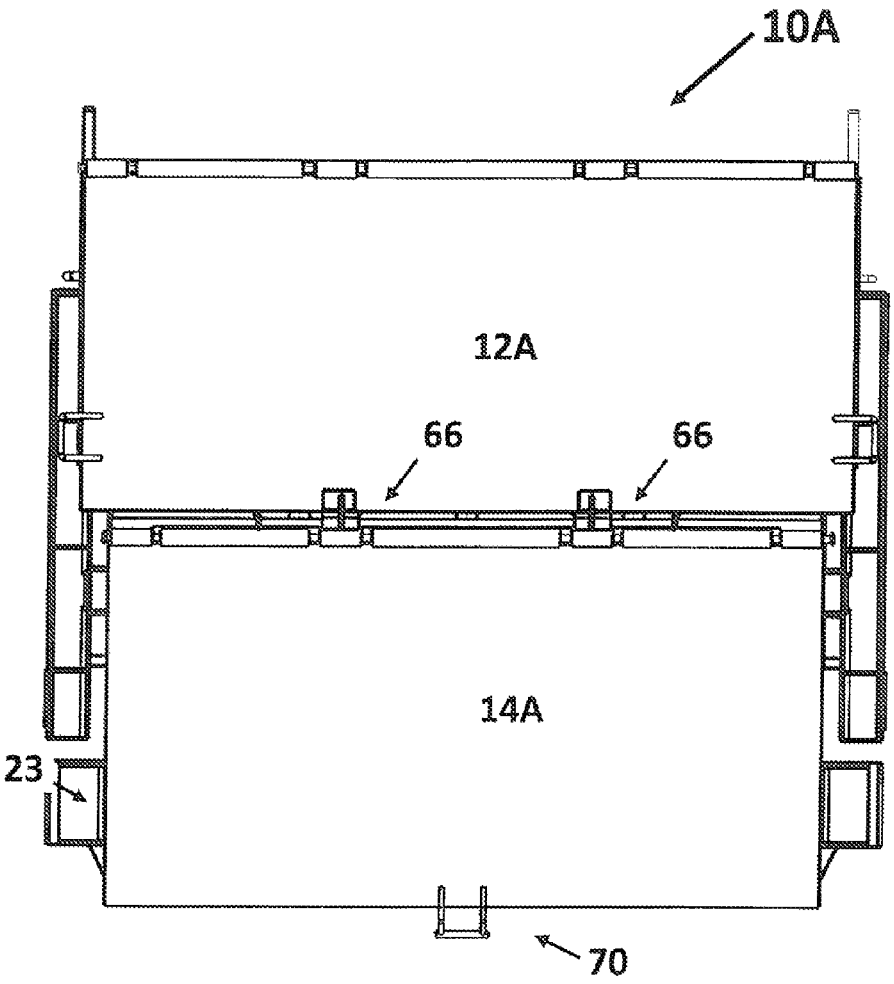
FIG. 1C is a top view of the device of FIG. 1A
Figure 2A:
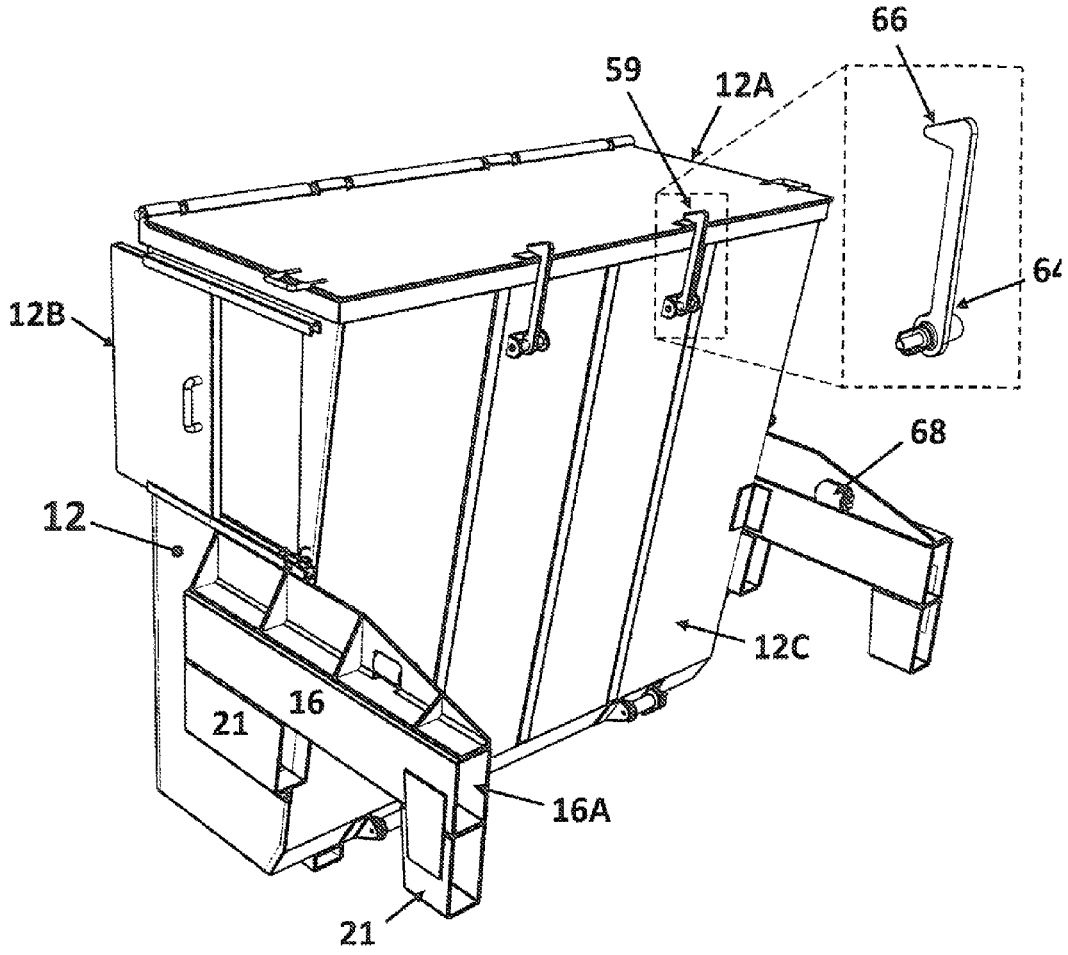
FIG. 2A is an elevated perspective view of the rear container of the device of FIG. 1A.
Figure 2B:
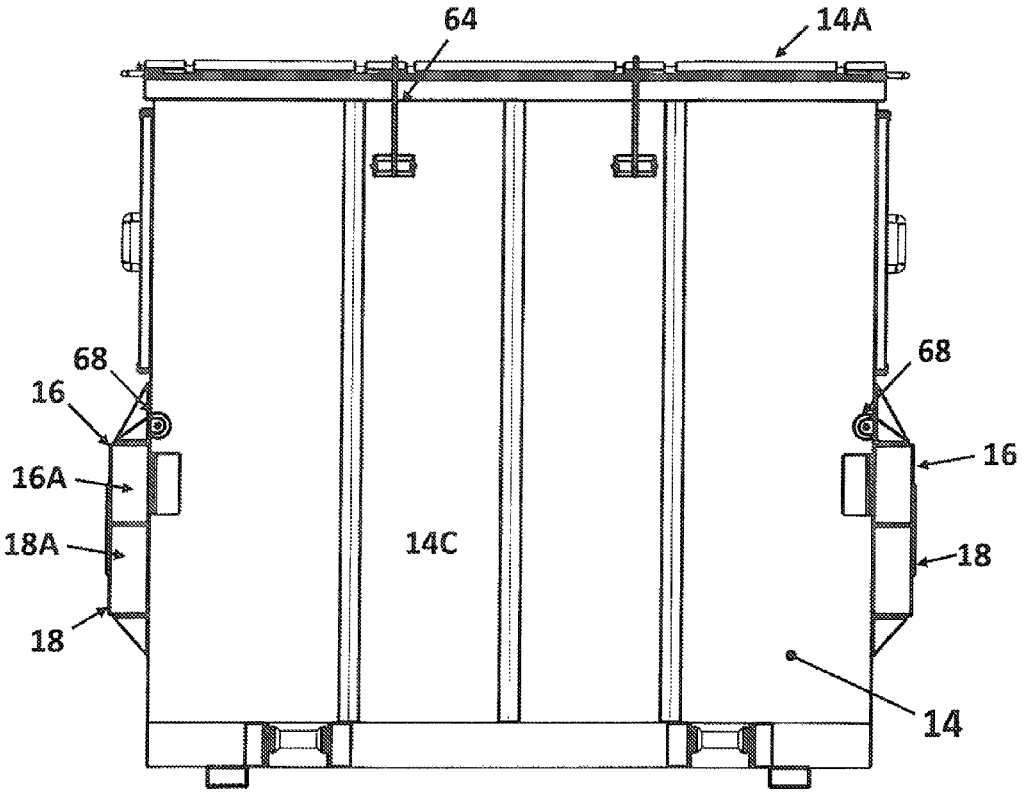
FIG. 2B is a front view of the rear container of the device of FIG. 1A.
Figure 3A:
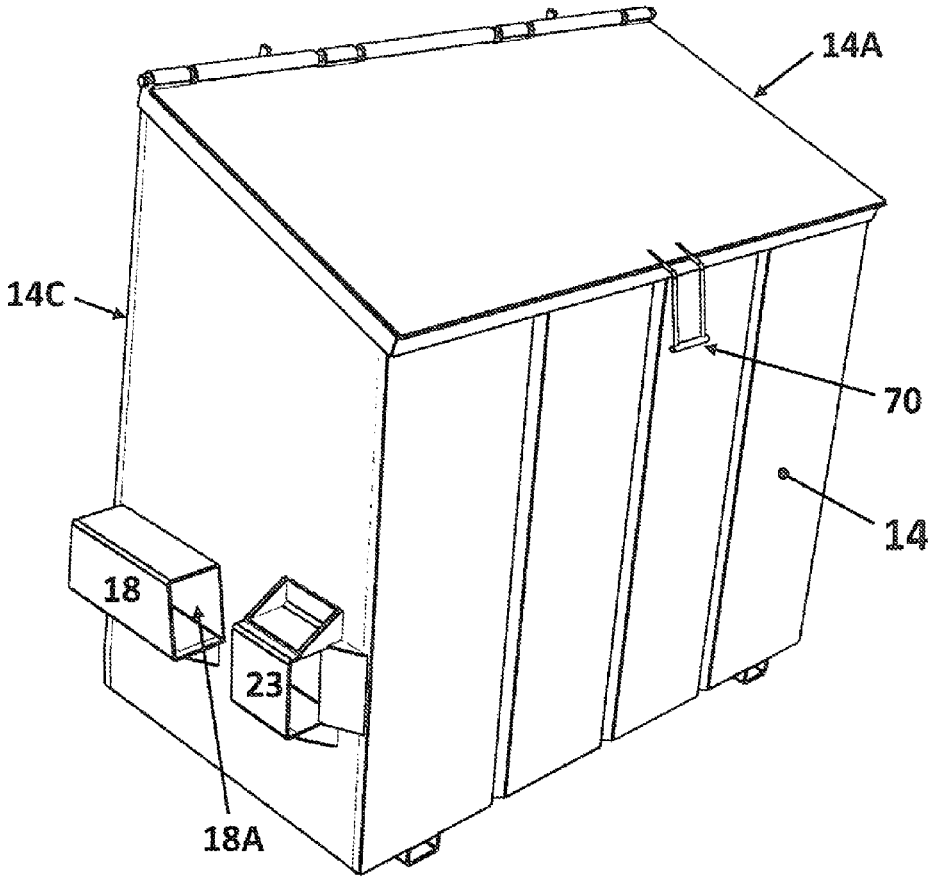
FIG. 3A is an elevated perspective view of the front container of the device of FIG. 1A.
Figure 3B:
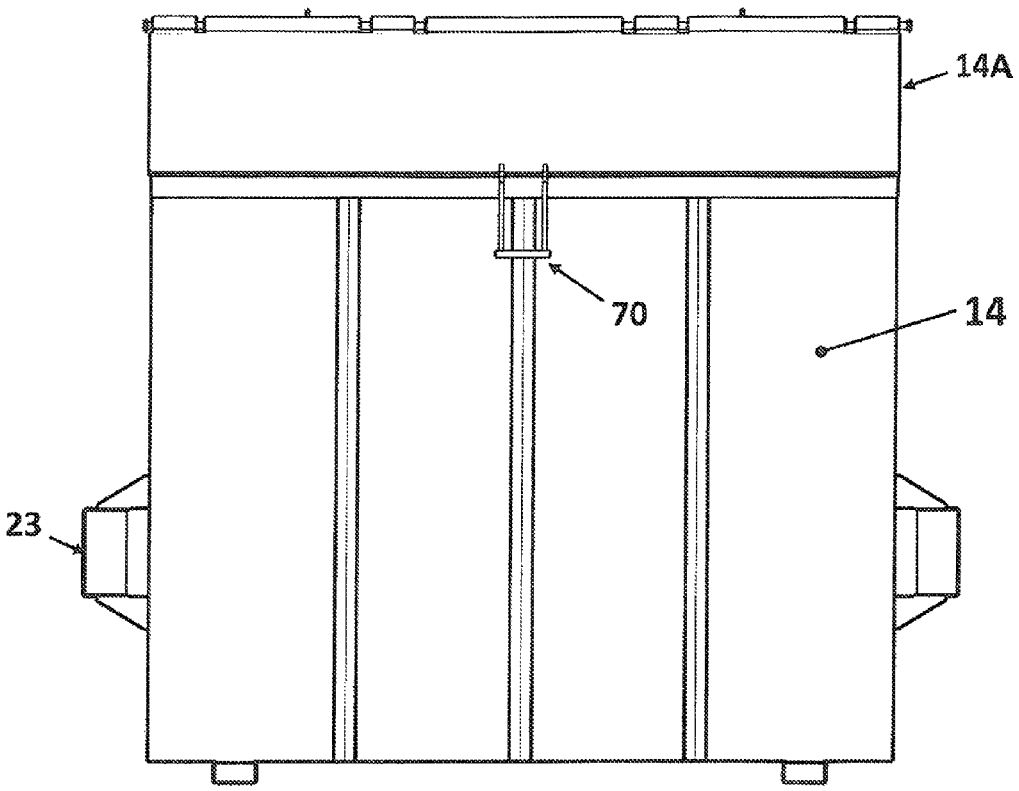
FIG. 3B is a front view of the front container of the device of FIG. 1A
Figure 4A:
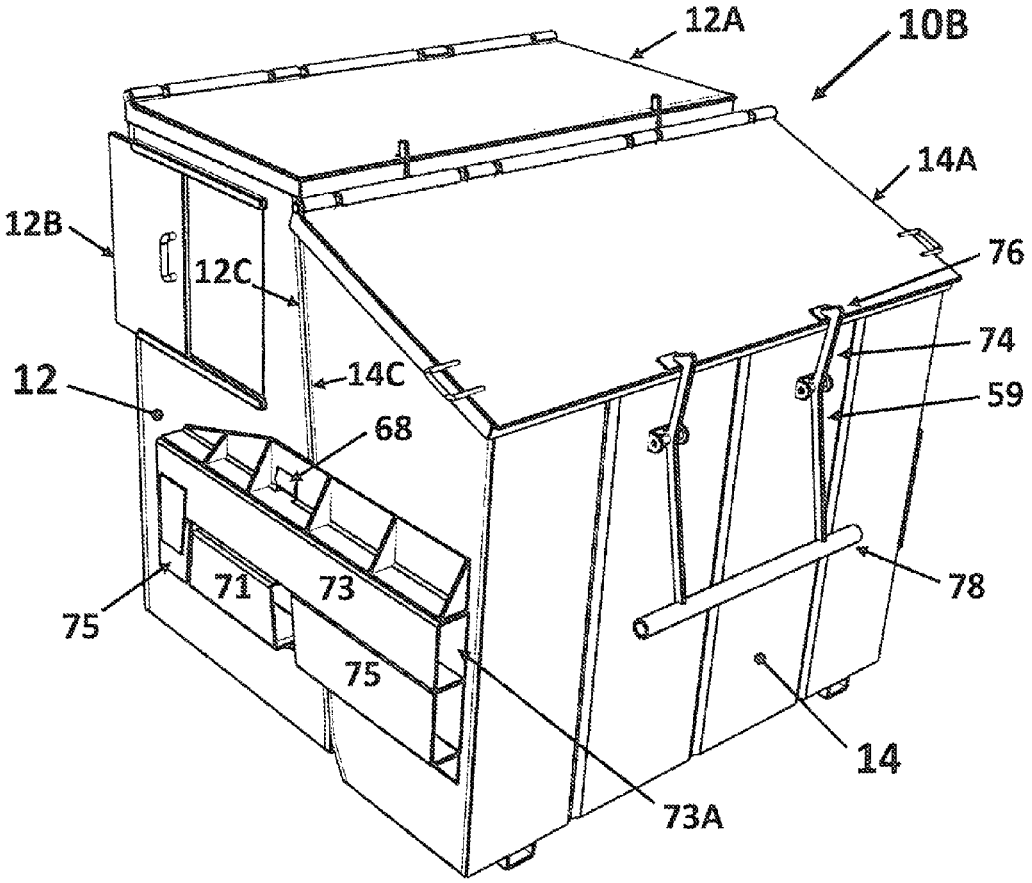
FIG. 4A is an elevated perspective view of another embodiment of the device of the present invention.
Figure 4B:
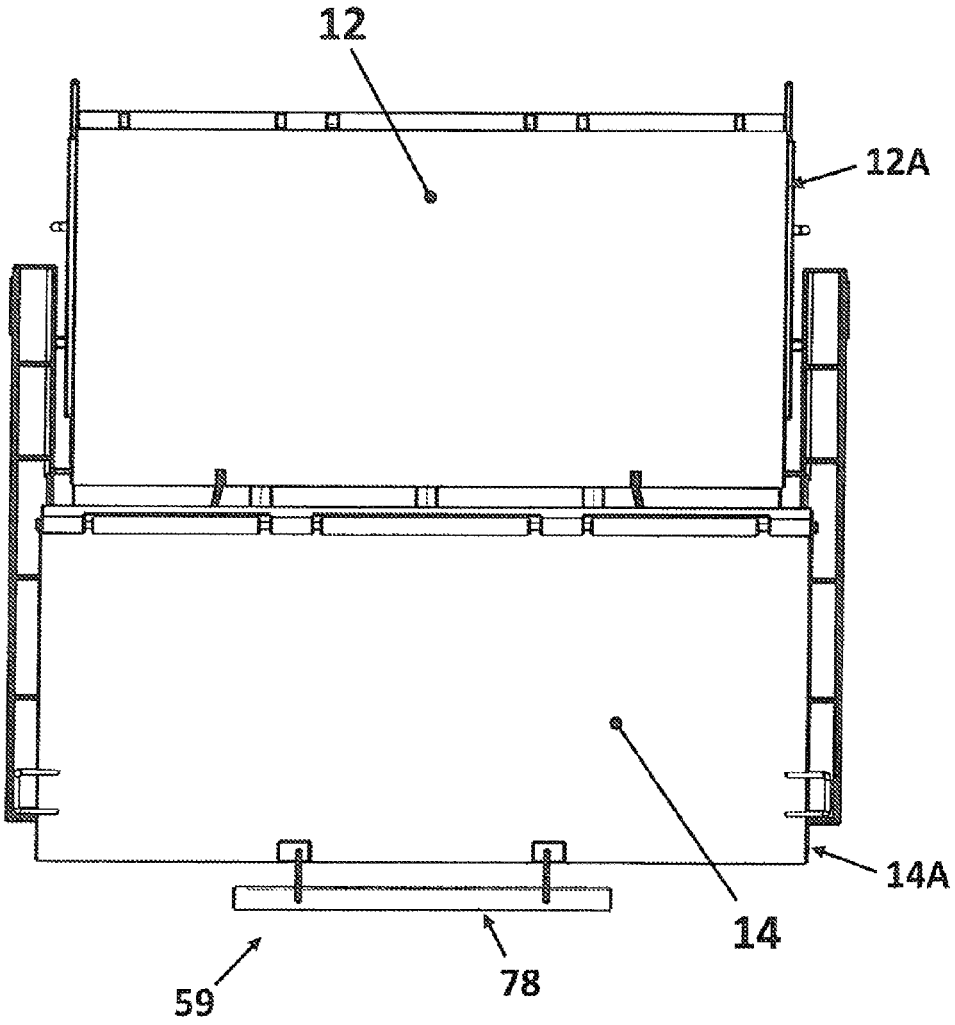
FIG. 4B is a top view of the device of FIG. 4A.
Figure 4C:
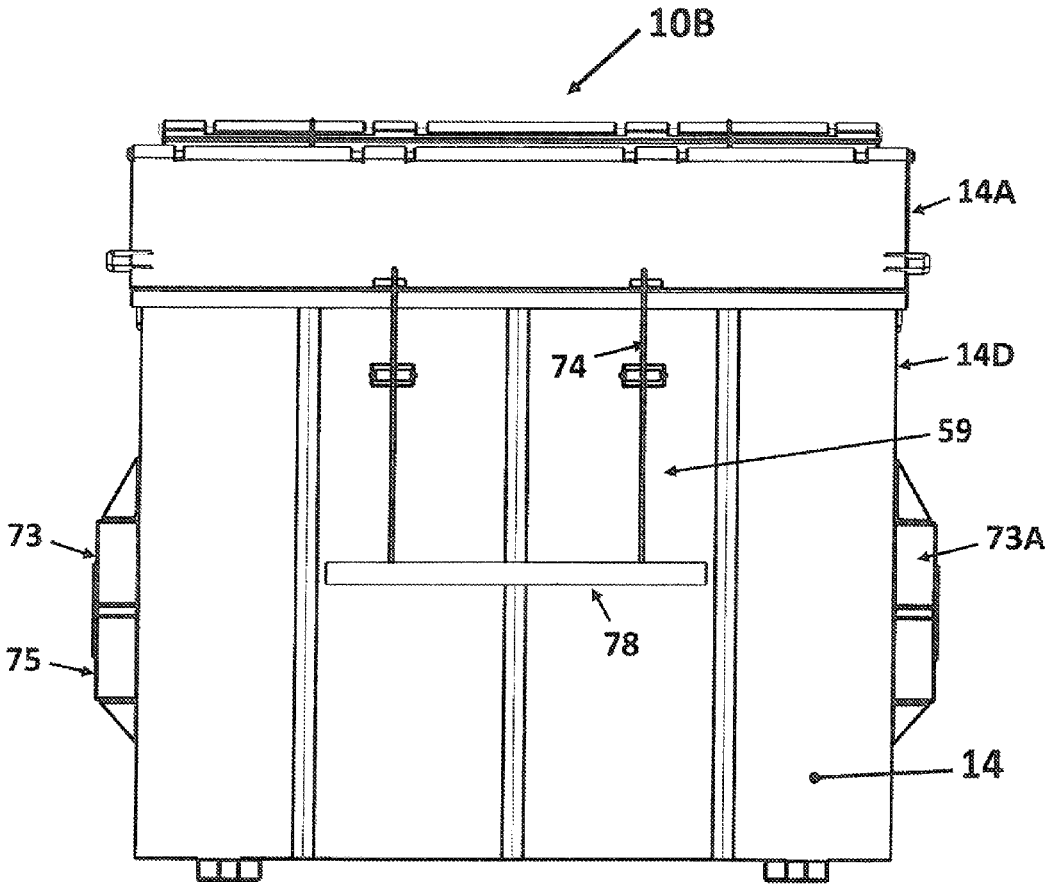
FIG. 4C is a front view of the device of FIG. 4A.
Figure 5A:
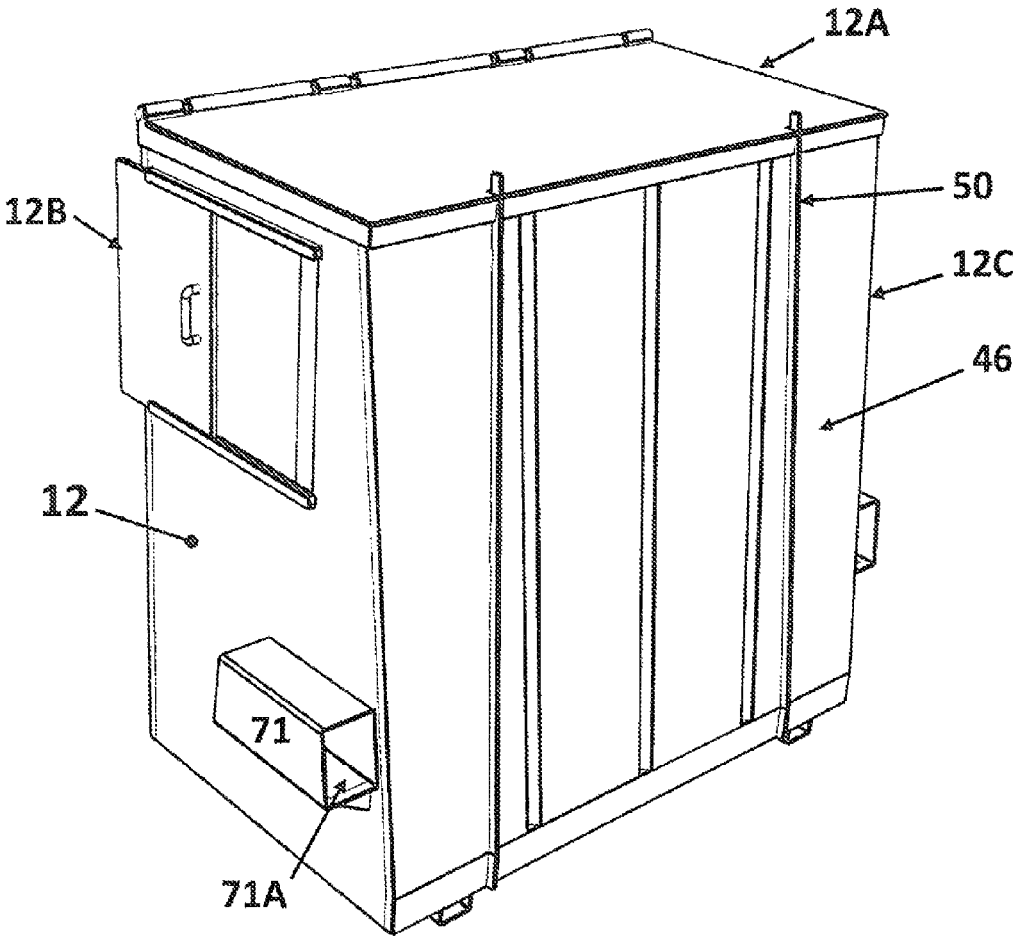
FIG. 5A is an elevated perspective view of the rear container of the device of FIG. 4A.
Figure 5B:
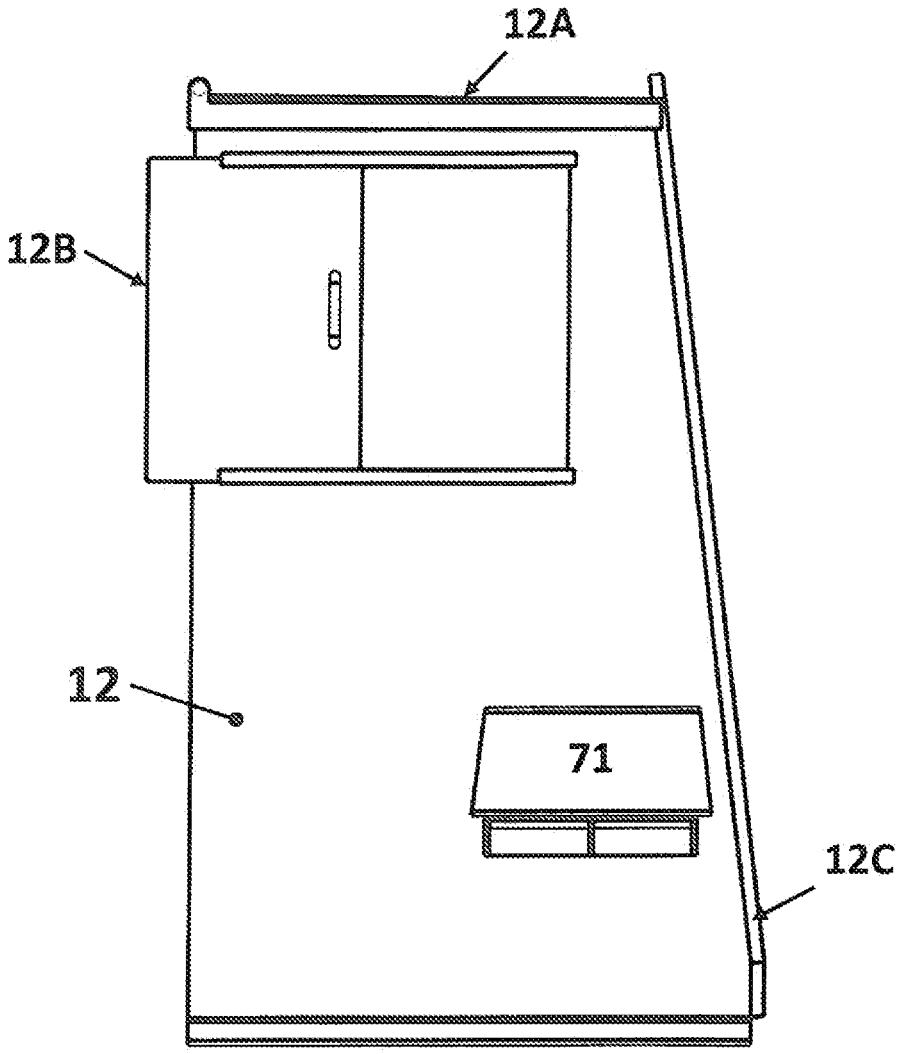
FIG. 5B is a side view of the rear container of the device of FIG. 4A.
Figure 5C:
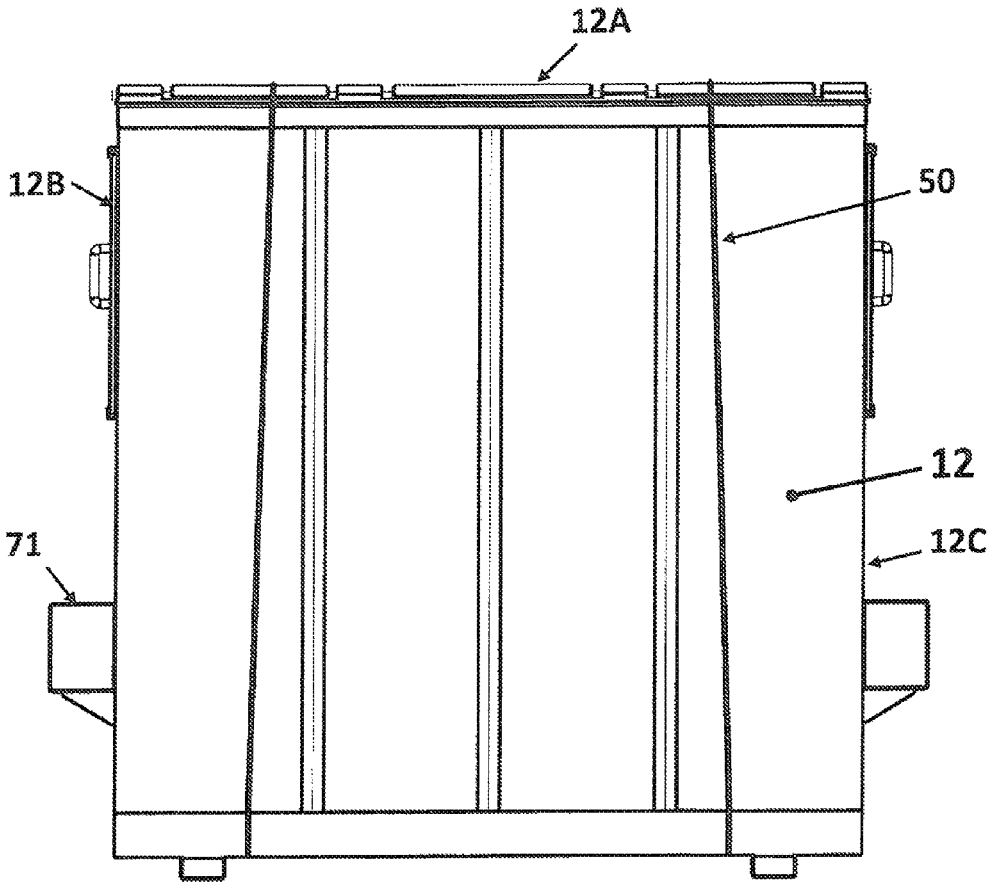
FIG. 5C is a front view of the rear container of the device of FIG. 4A.
Figure 6A:
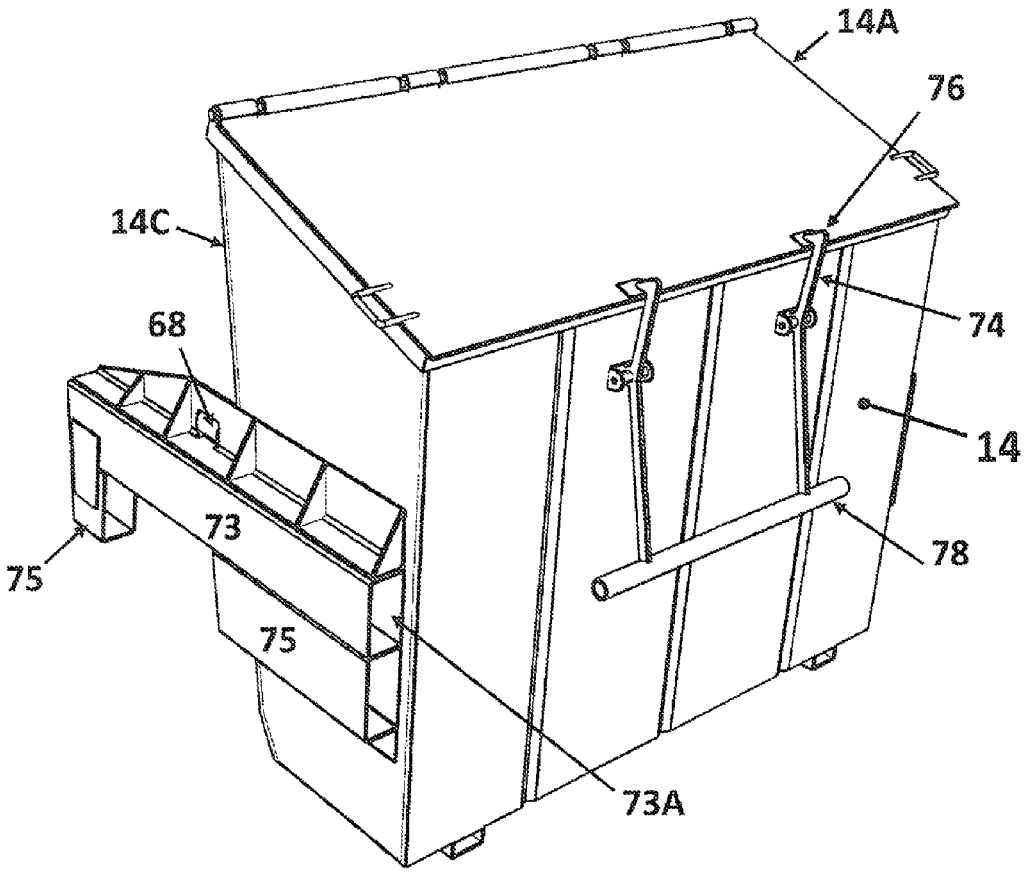
FIG. 6A is an elevated perspective view of the front container of the embodiment of the device shown in FIG. 4A.
Figure 6B:
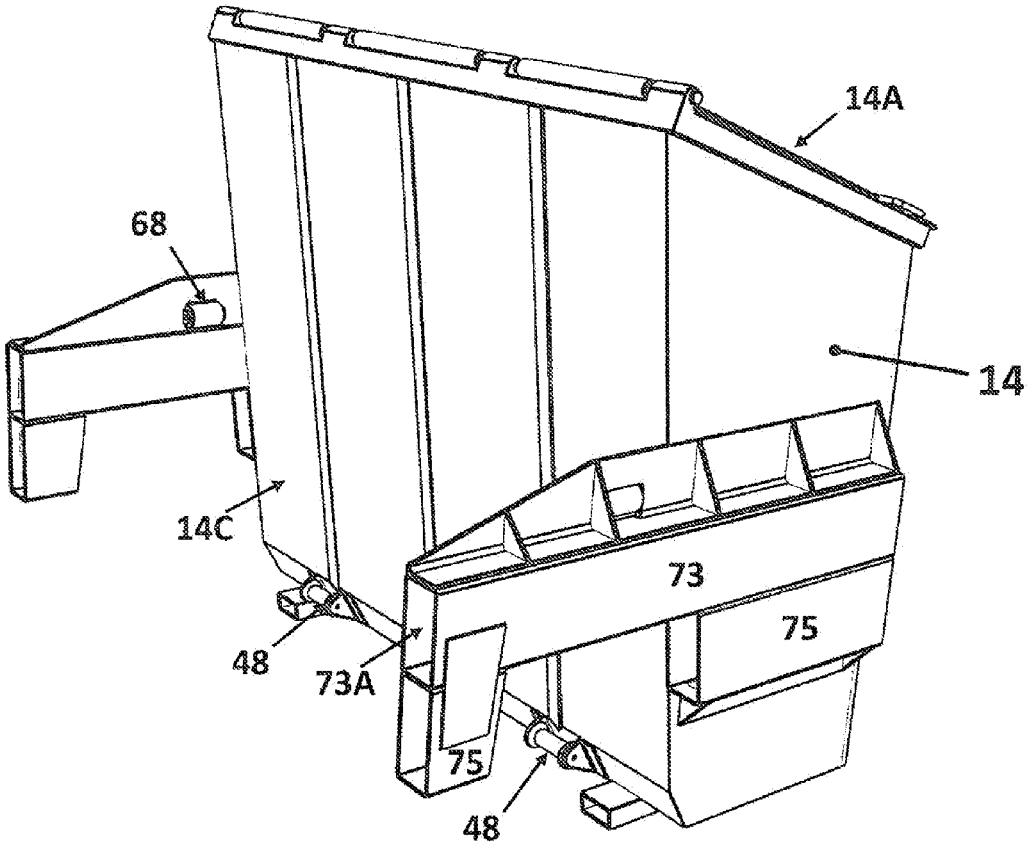
FIG. 6B is another elevated perspective view of the front container of the embodiment of the device shown in FIG. 4A.
Figure 6C:
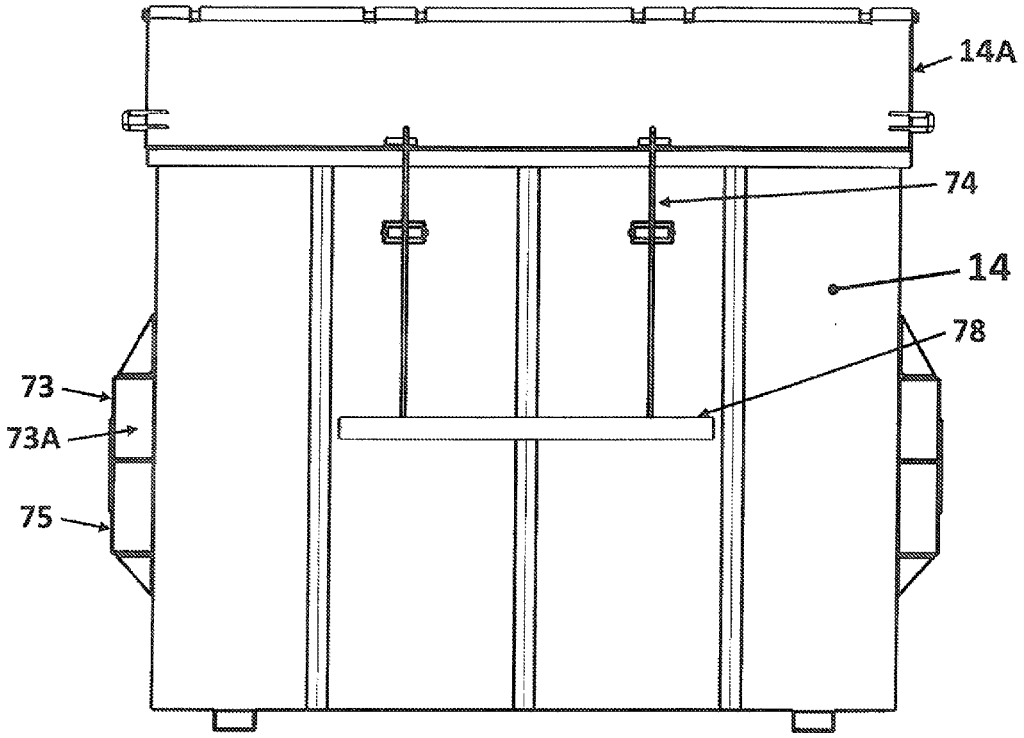
FIG. 6C is a front view of the front container of the embodiment of the device shown in FIG. 4A.
Figure 7A:
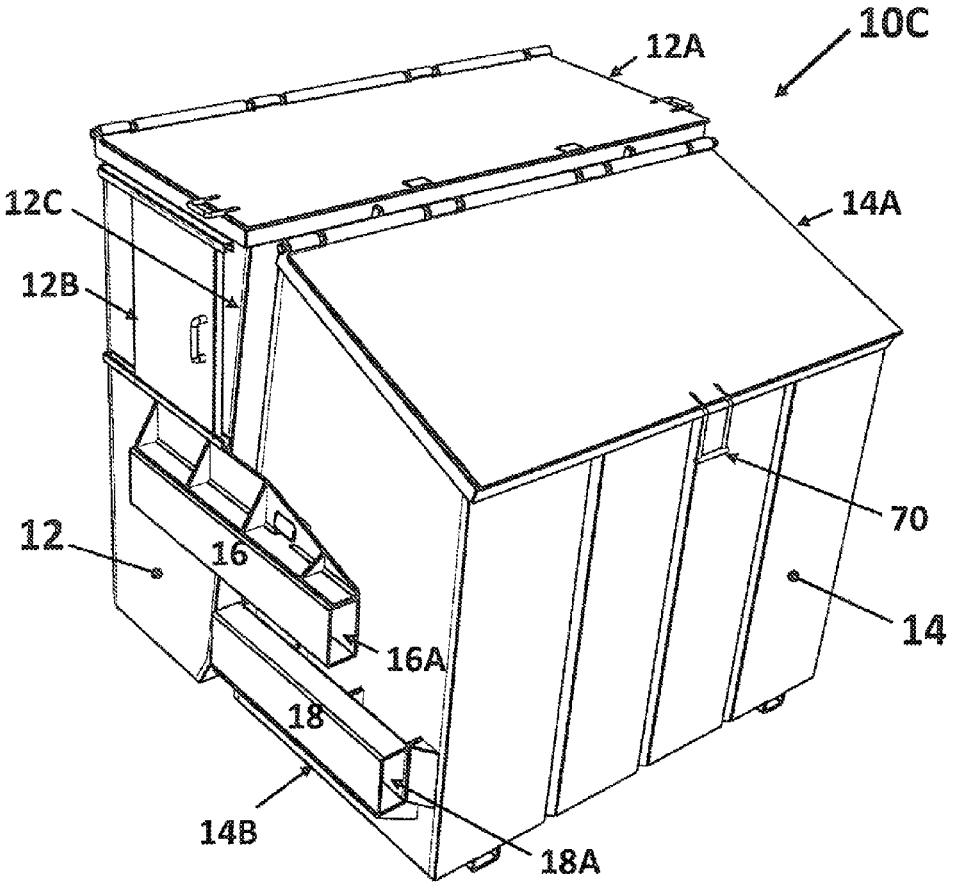
FIG. 7A is an elevated perspective view of another embodiment of the device of the present invention.
Figure 7B:
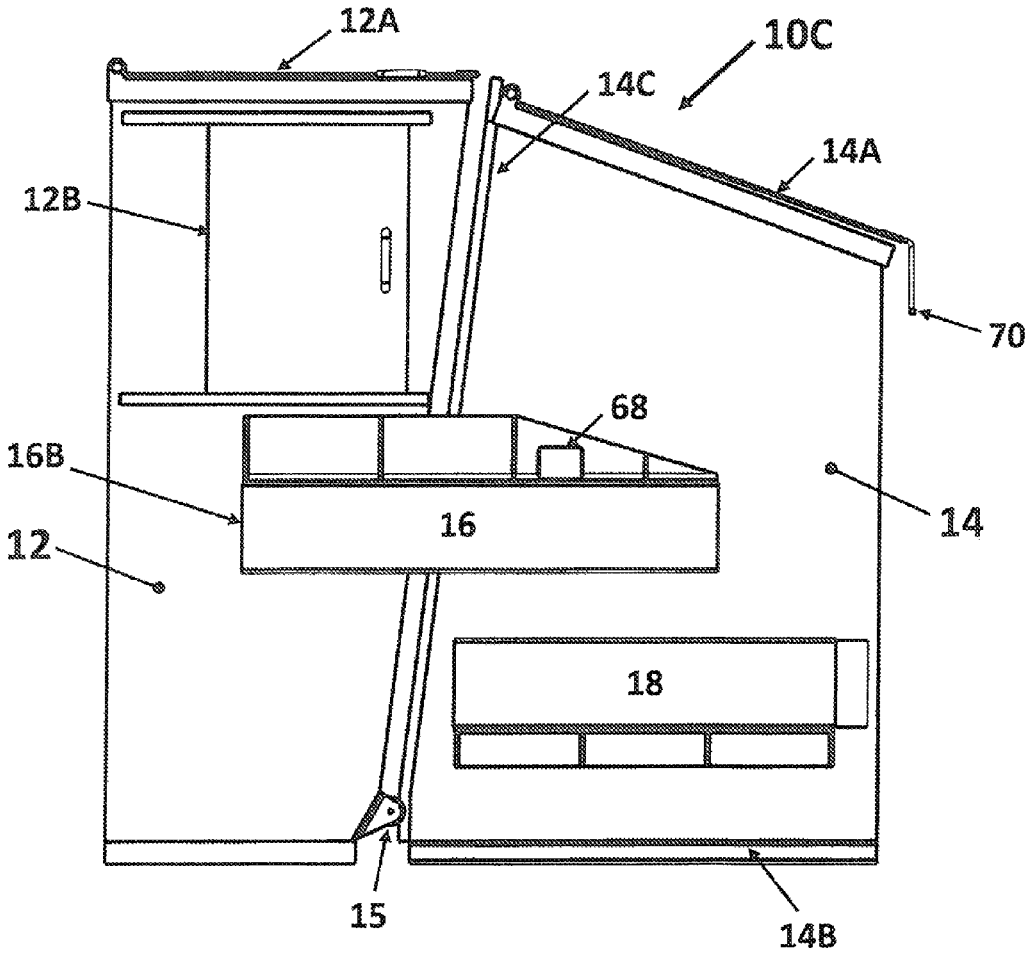
FIG. 7B is a side view of the device of FIG. 7A.
Figure 7C:
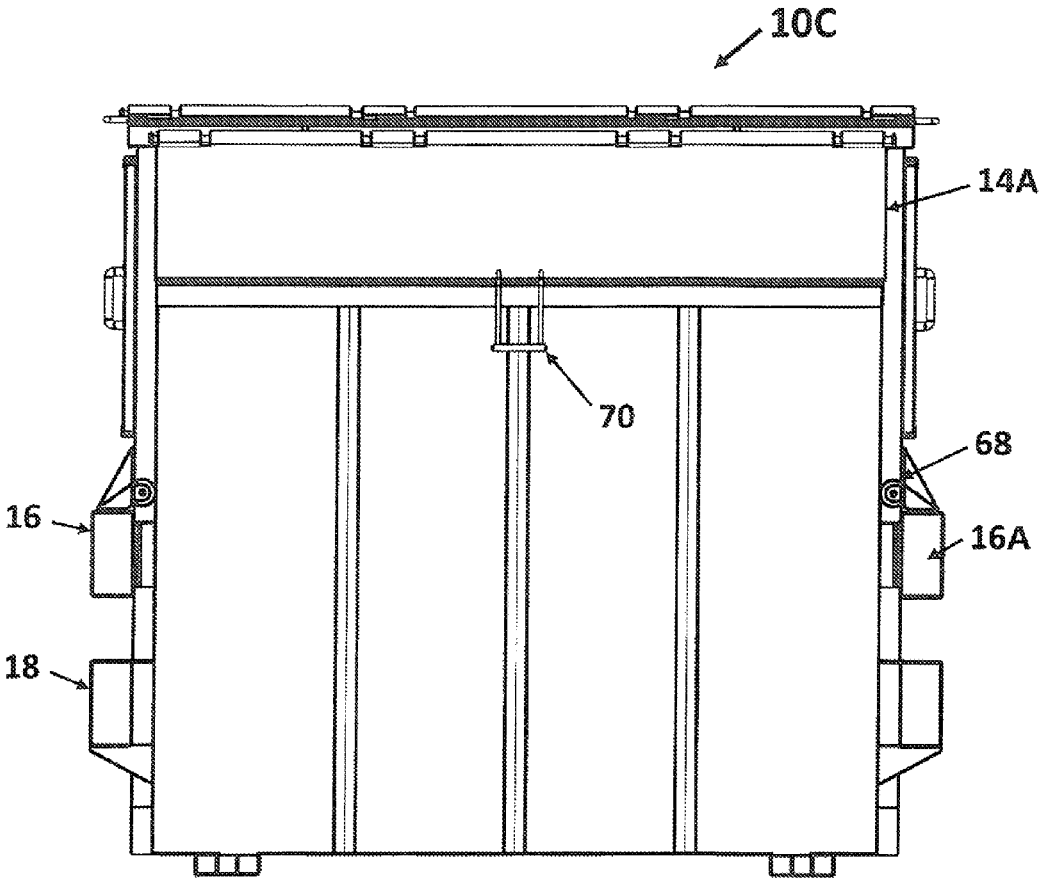
FIG. 7C is a front view of the device of FIG. 7A.
Figure 8A:
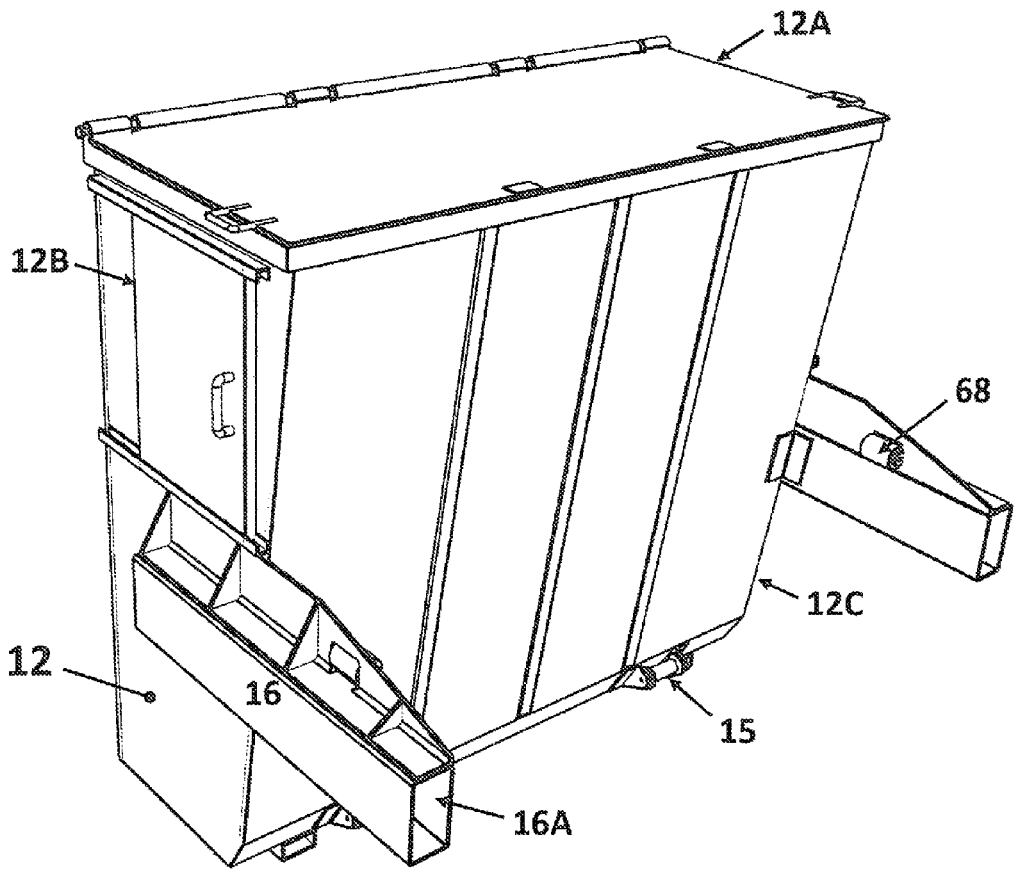
FIG. 8A is an elevated perspective view of the rear container of the device of FIG. 7A.
Figure 8B:
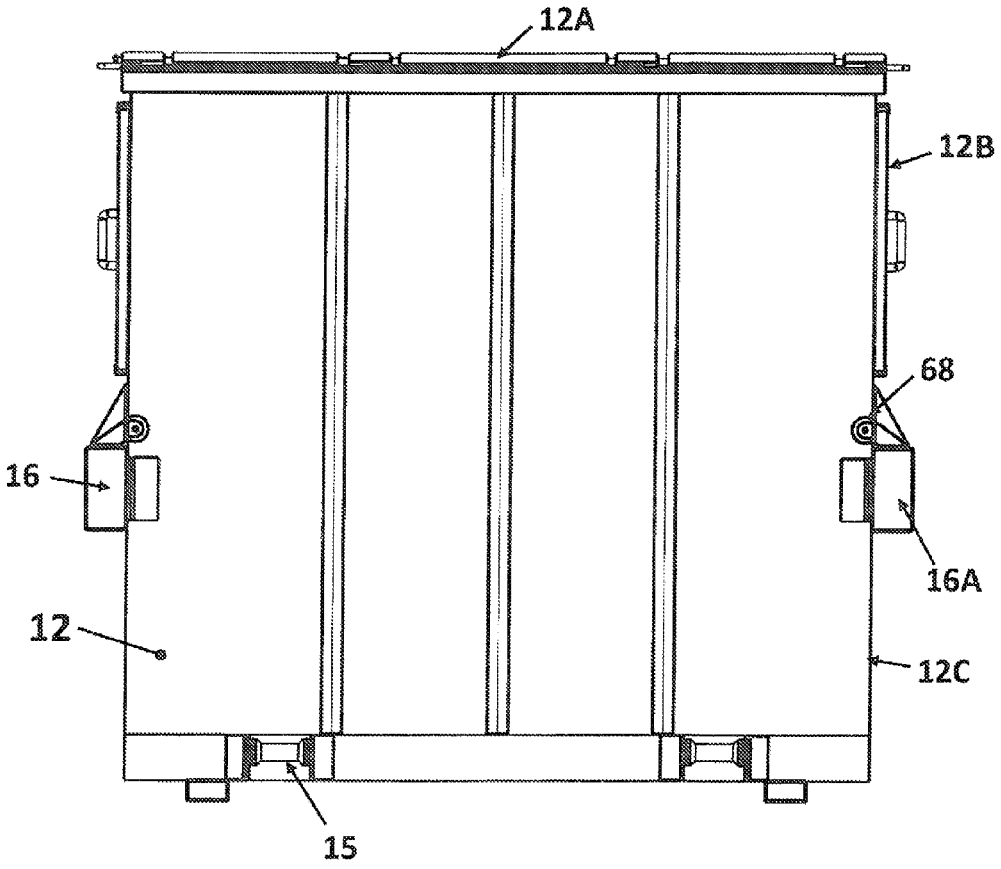
FIG. 8B is a front view of the rear container of the device of FIG. 7A.
Figure 9A:
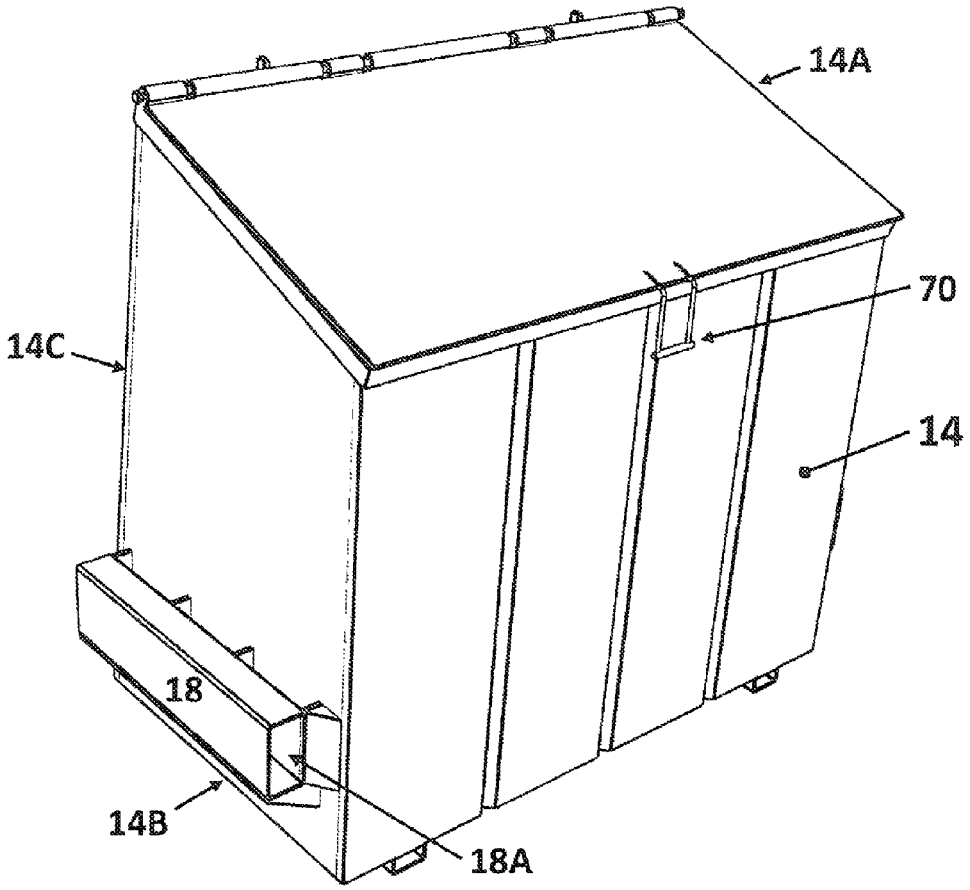
FIG. 9A is an elevated perspective view of the front container of the device of FIG. 7A.
Figure 9B:
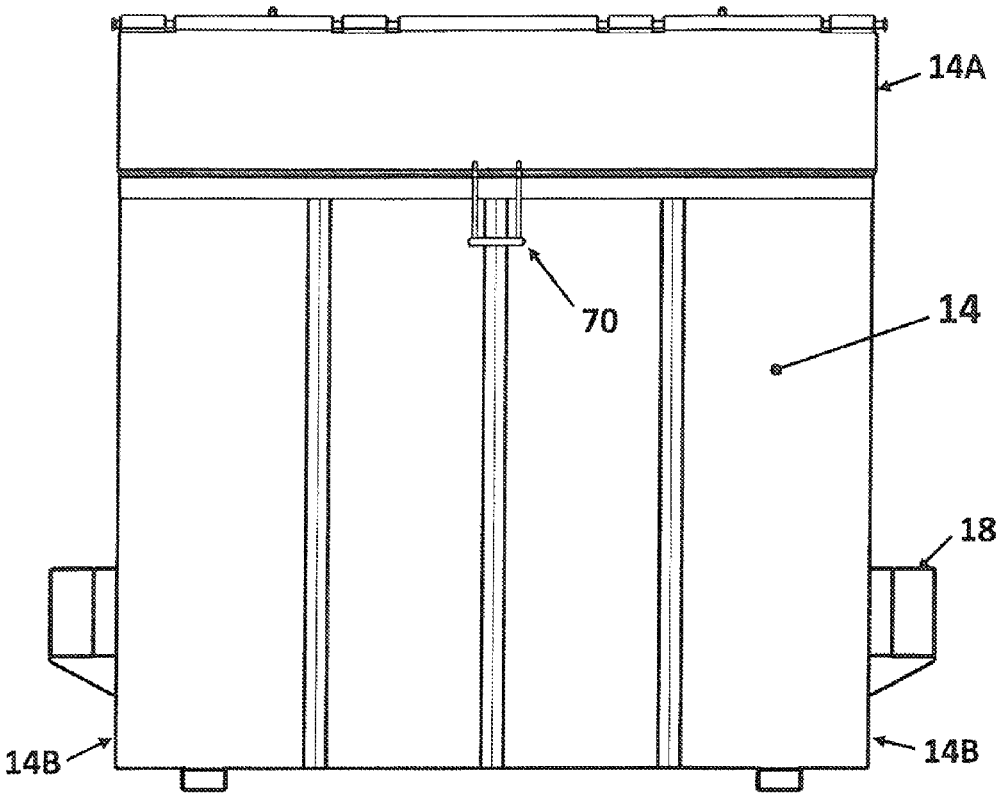
FIG. 9B is a front view of the front container of the device of FIG. 7A.
Figure 9C:
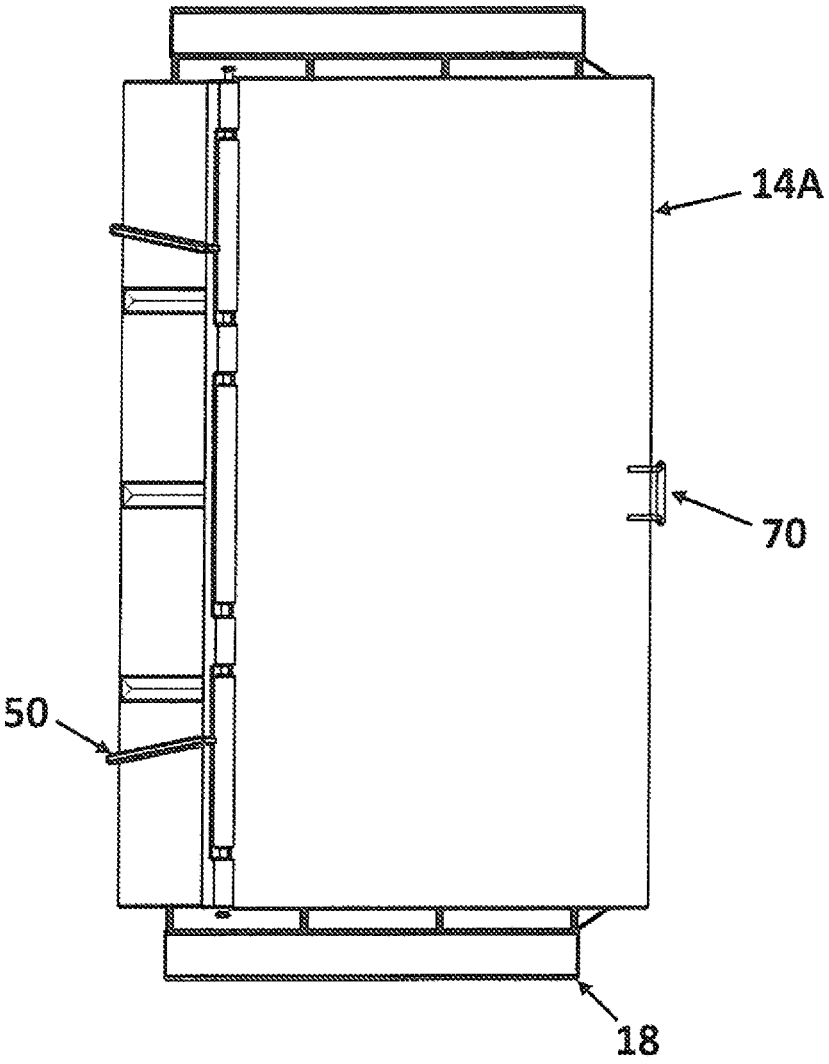
FIG. 9C is a top view of the front container of the device of FIG. 7A.

Referring to the Figures, a dual recyclables and non-recyclable waste collection device is disclosed. The dual recyclables and non-recyclable waste collection device will provide a commonly-sized bulk waste collection bin which is comprised of two separate containers, one being for recyclables, and the other being for non-recyclable waste.

Referring to FIGS. 1A-3B, the dual recyclables and non-recyclable waste collection device 10A (hereinafter device 10A) has a first container 12 and a second container 14. In this embodiment, either container 12 or 14 may house recyclables or non-recyclables. For further discussion, the first container 12 is used for non-recyclable waste collection and the second container 14 is used for recyclable waste collection. The first container 12 and second container 14 are generally made out of a sturdy metallic material such as steel or the like. However, other materials may be used without departing from the spirit and scope of the present invention.

The first container 12 and second container 14 may have lids 12A and 14A. A side door 12B may also be formed on the first container 12 and second container 14. In the present embodiment, the side door 12B is only formed in the first container 12. However, the side door 12B may be formed on one or both the first container 12 and or the second container 14.

In the embodiment shown in FIGS. 1A-3B, the first container 12 has an angled front surface 12C and the second container 14 has an angled rear surface 14C. The front surface 12C and the rear surface 14C are approximately parallel to one another. The angle of the front surface 12C and the rear surface 14C allow the first container 12 to more easily be raised and lifted away from the second container 14. The angle of the front surface 12C and the rear surface 14C further makes it easier to better align the first and second containers 12 and 14 so that there is a minimal gap between the front surface 12C and the rear surface 14C of the first and second containers 12 and 14.

The first container 12 will have a pair of sleeves 16. The pair of sleeves 16 is generally made out of the same material as the first and second containers 12 and 14. An individual sleeve of the pair of sleeve members 16 is attached to a middle section of each side section of the first container 12. The pair of sleeves 16 will extend away from the first container 12. By extending the pair of sleeves 16 away from the first container 12, the pair of sleeves 16 forms a guide for the placement of the second container 14. The pair of sleeves 16 will have a hollow channeling 16A. The hollow channeling 16A allows for a standard fork lift-operated garbage truck to insert the fork through the pair of sleeves 16 to raise and empty the first container 12.

The second container 14 will have a pair of sleeves 18. The pair of sleeves 18 is generally made out of the same material as the first and second containers 12 and 14. An individual sleeve of the pair of sleeve members 18 is attached to a middle bottom section of each side section of the second container 14 and below the pair of sleeves 16 on the first container 12. The pair of sleeves 18 will have a hollow channeling 18A.

Each sleeve 16 will have another sleeve 21 coupled to the underside of the sleeve 16. Sleeve 21 is formed to have an open central section. Thus, below each end of the sleeve 16 will be the sleeve 21 with the central area below sleeve 16 open. The pair of sleeves 21 is in alignment with the second pair of sleeves 18 on the second container 14. The central area of sleeve 21 is opened and spaced to enable the pair of sleeves of the second container 14 in between the opening. The sleeve 21 serves two purposes. First, sleeve 21 is used in combination with sleeves 18 to simultaneous lift the two containers 12 and 14 without movement of the two containers 12 and 14 with respect to one another. Second, the opening in sleeves 21 are used as an alignment device when placing the first container 12 back in position so that there is a minimal gap between the front surface 12C and the rear surface 14C of the first and second containers 12 and 14.

The second pair of sleeves 18 is formed to have angled side edges. Sleeves 21 also have angled side edges so that the side edges of sleeves 18 run approximately parallel with the side edges of sleeves 21. The angled sides edges of the sleeves 18 and 21 further serve as alignment mechanisms when placing the first container 12 back in position so that there is a minimal gap between the front surface 12C and the rear surface 14C of the first and second containers 12 and 14.

The second container 14 may have an additional pair of sleeves 23. The sleeves 23 are spaced from the pair of sleeves 18 to enable placement of the pair of sleeves 21 of the first container 12 between the pairs of sleeves 18 and 23. Accordingly, the four pairs of sleeves 18, 20, 21, and 23 will be in alignment when the device 10A is in its resting position, and will prevent movement of the containers 12 and 14 with respect to one another upon simultaneous lifting of the containers 12 and 14.

Since in this embodiment the device 10A enables simultaneous lifting of the two containers 12 and 14, device 10A will also include a locking device 59 to secure the lid 12A of the first container 12. This will allow the emptying of only second container 14 when simultaneous lifting of the two containers 12 and 14 for emptying. The first container 12 can still be lifted and emptied individually like in the previous embodiment.

In the present embodiment, the locking mechanism 59 for lid 12A is a latch 64. The latch 64 is hingly coupled to the front surface 12C of the first container 12. The latch 64 has a hook 66 which will engage the lid 12A to lock the lid 12A when the first container 12 and second container 14 are positioned together. When the first container 12 and second container 14 are lifted together, the second container 14 will press the latch 64 forward so that the hook 66 will engage and lock the lid 12A. Thus, the lid 12A will remain closed when both the first container 12 and second container 14 are lifted together. When the forks of a standard dump truck pass through the pair of sleeves 16 to lift just the first container 12 slightly above the second container 14, the angle of the front surface of the first container causes the latch 64 to fall forward so that the hook disengages the lid 12A. This unlocks the lid 12A thereby allowing the lid 12A to open when the first container 12 is emptied.

In the present embodiment, rollers 68 are placed on the interior side of the sleeves 16. The rollers 68 are positioned on the section of the sleeves 16 that extend away from the first container 12. The rollers 68 are used to allow the first container 12 to more easily be lifted away from and realigned with the second container 14.

A handle 70 may be attached to the lid 14A of the second container 14. The handle 70 is used to raise the lid 14A to insert any refuse into the second container 14.

Referring to FIGS. 4A-6C, another embodiment of the device 10B is shown. As in the previous embodiment, the device 10B has a first container 12 and a second container 14. The first container 12 and second container 14 may have lids 12A and 14A. A side door 12B may also be formed on the first container 12 and second container 14.

The first container 12 may have an angled front surface 12C and the second container 14 has an angled rear surface 14C. The front surface 12C and the rear surface 14C are approximately parallel to one another. The angle of the front surface 12C and the rear surface 14C allow the second container to more easily be raised and lifted away from the first container 12. The angle of the front surface 12C and the rear surface 14C further makes it easier to better align the first and second containers 12 and 14 so that there is a minimal gap between the front surface 12C and the rear surface 14C of the first and second containers 12 and 14.

The first container 12 will have a pair of sleeves 71. The pair of sleeves 71 is generally made out of the same material as the first and second containers 12 and 14. An individual sleeve of the pair of sleeve members 71 is attached to a bottom section of each side section of the first container 12. The pair of sleeves 71 will extend to the edge of the first container 12. The pair of sleeves 71 will have a hollow channeling 71A. The hollow channeling 71A allows for a standard fork lift-operated garbage truck to insert the fork through the pair of sleeves 71.

The second container 14 will have a pair of sleeves 73. The pair of sleeves 73 is generally made out of the same material as the first and second containers 12 and 14. An individual sleeve of the pair of sleeve members 73 is attached to a middle section of each side section of the second container 14 and above the pair of sleeves 71 on the first container 12. The pair of sleeves 73 will extend away from the second container 12 towards the first container 12. By extending the pair of sleeves 73 away from the second container 12, the pair of sleeves 73 forms a guide for the placement of the first container 12. The pair of sleeves 73 will have a hollow channeling 73A.

Each sleeve 73 will have another sleeve 75 coupled to the underside of the sleeve 73. Sleeve 75 is formed to have an open central section. Thus, below each end of the sleeve 73 will be the sleeve 75 with the central area below sleeve 73 open. The pair of sleeves 75 is in alignment with the pair of sleeves 71 on the first container 14. The central area of sleeve 75 is opened and spaced to enable the pair of sleeves 71 of the first container 12 in between the opening. The sleeve 75 serves two purposes. First, sleeve 75 is used in combination with sleeves 71 to simultaneous lift the two containers 12 and 14 without movement of the two containers 12 and 14 with respect to one another. Second, the opening in sleeves 75 are used as an alignment device when placing the second container 14 back in position so that there is a minimal gap between the front surface 12C and the rear surface 14C of the first and second containers 12 and 14.

The pair of sleeves 71 is formed to have angled side edges. Sleeves 75 also have angled side edges so that the side edges of sleeves 71 run approximately parallel with the side edges of sleeves 75. The angled sides edges of the sleeves 71 and 75 further serve as alignment mechanisms when placing the first container 12 back in position so that there is a minimal gap between the front surface 12C and the rear surface 14C of the first and second containers 12 and 14.

Since in this embodiment the device 10B enables simultaneous lifting of the two containers 12 and 14, device 10B will also include a locking device 59. However, in this embodiment, the locking device 59 is used to secure the lid 14A of the second container 14. This will allow the emptying of only the first container 12 when simultaneous lifting of the two containers 12 and 14 for emptying.

In the present embodiment, the locking mechanism 59 has one or more rod members 74 hingly coupled to a top area of the front surface 14D of the second container 14. On one end of each rod member 74 is a hook 76. The hook 76 engages the lid 14A when the rod member 74 is in a first position thereby locking the lid 14. When the rod member 74 is placed in a second position, the hook 76 disengages from the lid 14A allowing one to lift the lid 14A. Attached to a second end of the rod member 74 is a lever 78. By pushing or pulling the lever 78, one can lock and unlock the lid 14A. It should be noted that the locking mechanism 59 of the present embodiment may be used with other embodiments of the invention.

In operation, when the forks of a standard dump truck pass through the pair of sleeves 73 to lift the second container 14 only, a cross member connecting the forks 25 will press against the lever 78 unlocking the lid 14A so that the contents of the second container 14 may be emptied. When the forks 25 of the dump truck pass through the two sets of sleeves 75 and 71 the dump truck can simultaneous lift the two containers 12 and 14. The locking mechanism 59 ensures that the contents of only the first container 12 will be emptied.

In this embodiment, an aligning mechanism 46 is used to properly align the first container 12 with the second container 14. It should be noted that the alignment mechanism 46 may be used on any of the previous embodiments or any of the following embodiments for ensuring the alignment of the first container 12 with the second container 14.

In the present embodiment, the aligning mechanism 46 will have a set of rollers 48 coupled to a rear surface 14C of the second container 14. A corresponding pair of guide rails 50 is coupled to the front surface 12A of the first container 12. When the first container 12 is lowered into position in proximity of the second container 14, the rollers 48 will mate with the guide rails 50 thereby causing the two containers 12 and 14 to align.

In accordance with one embodiment, the pair of guiderails 50 will be slightly tapered so that the pair of guiderails 50 is closer in proximity to each other at the top of the second container 14 than at the bottom of the second container 14. Accordingly, the pair of guiderails 50 will be wedged between opposite ends of the set of rollers 48 as the first container 12 is lowered into position in proximity of the second container 14 and thereby cause the two containers 12 and 14 to align.

In the present embodiment, rollers 68 are placed on the interior side of the sleeves 16. The rollers 68 are positioned on the section of the sleeves 16 that extend away from the first container 12. The rollers 68 are used to allow the second container 14 to more easily be lifted away from and realigned with the first container 12.

Referring to FIGS. 7A-9C, another embodiment of the device 10C is shown. In this embodiment, either container 12 or 14 may house recyclables or non-recyclables. The first container 12 and second container 14 are generally made out of a sturdy metallic material such as steel or the like. However, other materials may be used without departing from the spirit and scope of the present invention.

The first container 12 and second container 14 may have lids 12A and 14A. A side door 12B may also be formed on the first container 12 and second container 14. In the present embodiment, the side door 12B is only formed in the first container 12. However, the side door 12B may be formed on one or both the first container 12 and or the second container 14.

The first container 12 has an angled front surface 12C and the second container 14 has an angled rear surface 14C. The front surface 12C and the rear surface 14C are approximately parallel to one another. The angle of the front surface 12C and the rear surface 14C allow the first container 12 to more easily be raised and lifted away from the second container 14. The angle of the front surface 12C and the rear surface 14C further makes it easier to better align the first and second containers 12 and 14 so that there is a minimal gap between the front surface 12C and the rear surface 14C of the first and second containers 12 and 14.

The first container 12 will have a pair of sleeves 16. The pair of sleeves 16 is generally made out of the same material as the first and second containers 12 and 14. An individual sleeve of the pair of sleeve members 16 is attached to a middle section of each side section of the first container 12. The pair of sleeves 16 will extend away from the first container 12. By extending the pair of sleeves 16 away from the first container 12, the pair of sleeves 16 forms a guide for the placement of the second container 14. The pair of sleeves 16 will have a hollow channeling 16A. The hollow channeling 16A allows for a standard fork lift-operated garbage truck to insert the fork through the pair of sleeves 16 to raise and empty the first container 12.

The second container 14 will have a pair of sleeves 18. The pair of sleeves 18 is generally made out of the same material as the first and second containers 12 and 14. An individual sleeve of the pair of sleeve members 18 is attached to a middle bottom section of each side section of the second container 14. The pair of sleeves 18 will have a hollow channeling 18A. The hollow channeling 18A allows for a standard fork lift-operated garbage truck to insert the fork through the pair of sleeves 16 to raise and empty the second container 14. In the present embodiment, the sleeves 18 extend approximately a length of the side section 14B of the second container.

In order to further aid the ability to raise, lift away and realign the first container 12 and the second container 14, one or more rollers 15 may be placed on the outer perimeter of the front surface 12C of the first container 12. The rollers 15 will prevent the front surface 12C of the first container 12 from damaging the rear surface 14C by allowing the first container 12 to roll on the second container 14 during emptying of the first container 12. The rollers 15 further act as a bumper when repositioning the second container 14 after emptying the second container 14.

In the present embodiment, rollers 68 are placed on the interior side of the sleeves 16. The rollers 68 are positioned on the section of the sleeves 16 that extend away from the first container 12. The rollers 68 are used to allow the first container 12 to more easily be lifted away from and realigned with the second container 14.

A handle 70 may be attached to the lid 14A of the second container 14. The handle 70 is used to raise the lid 14A to insert any refuse into the second container 14.

Figure 10A:
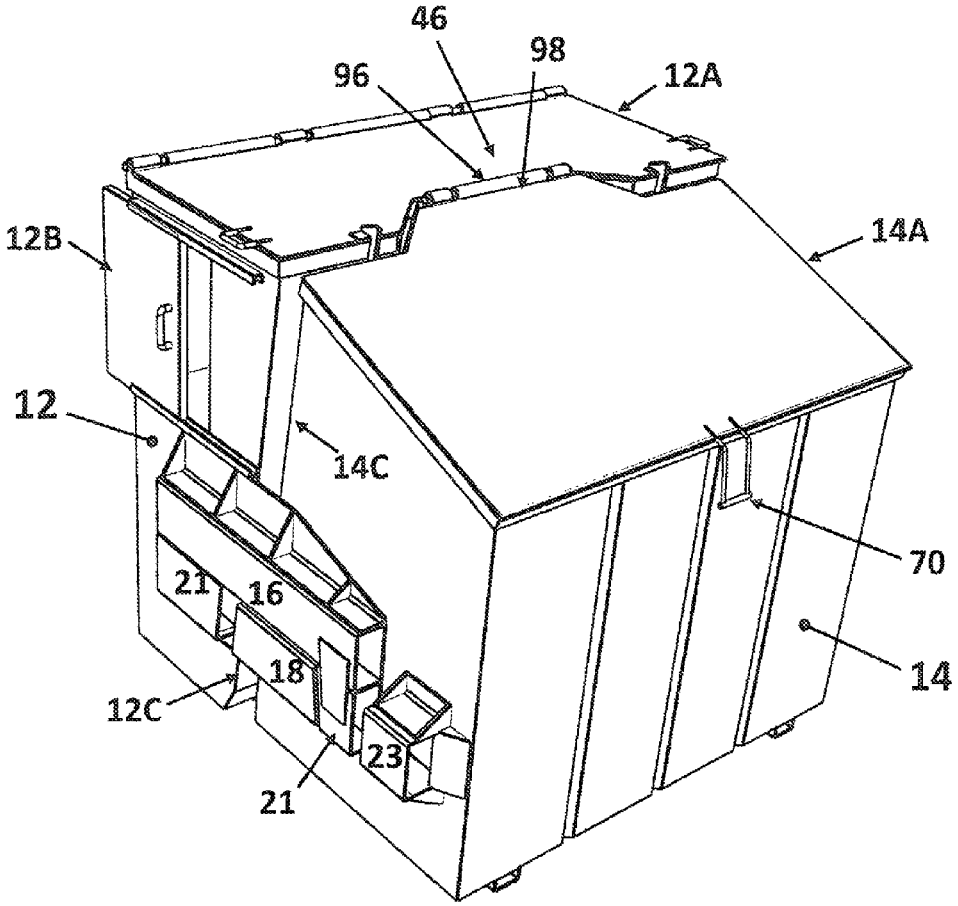
FIG. 10A is an elevated perspective view showing an alignment mechanism for any of the embodiments of the present invention.
Figure 10B:
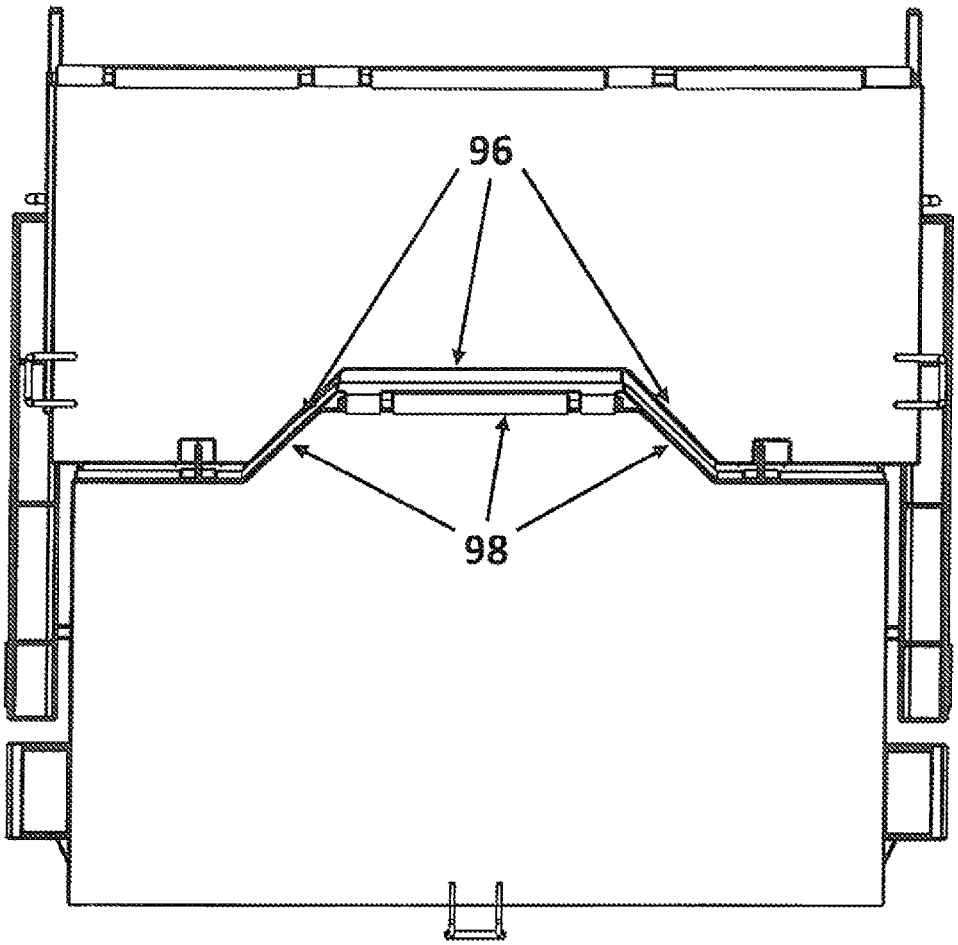
FIG. 10B is a top view of the alignment mechanism of FIG. 10A.

Referring now to FIGS. 10A-10B, another embodiment of the aligning mechanism 46 is shown. In the present embodiment, the aligning mechanism 46 takes the form of interlocking corrugated front and rear surfaces 12C and 14C respectively. As shown in FIGS. 10A-10B front and rear surfaces 12C and 14C have corresponding notches 96 and tabs 98 which help to align the first and second containers 12 and 14.

Figure 11A:
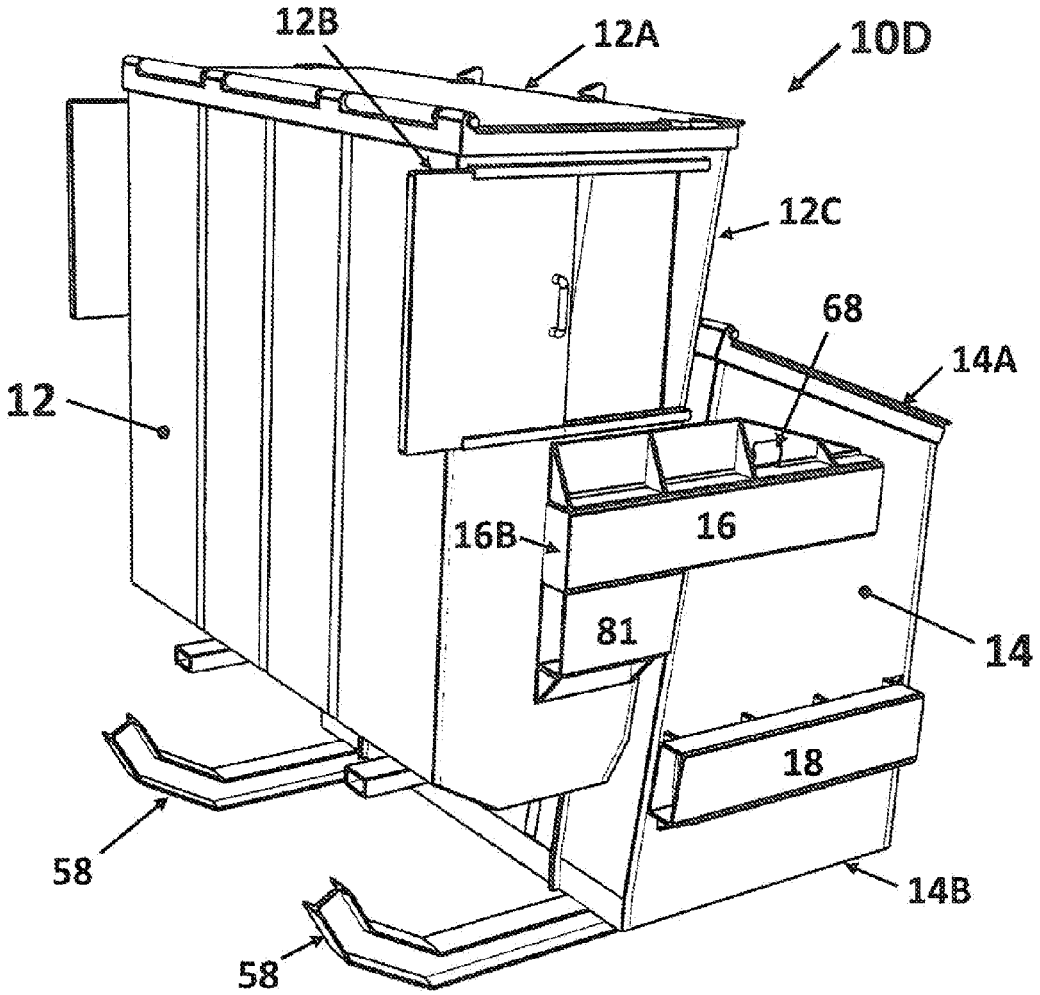
FIG. 11A is an elevated perspective view of another embodiment of the present invention.
Figure 11B:
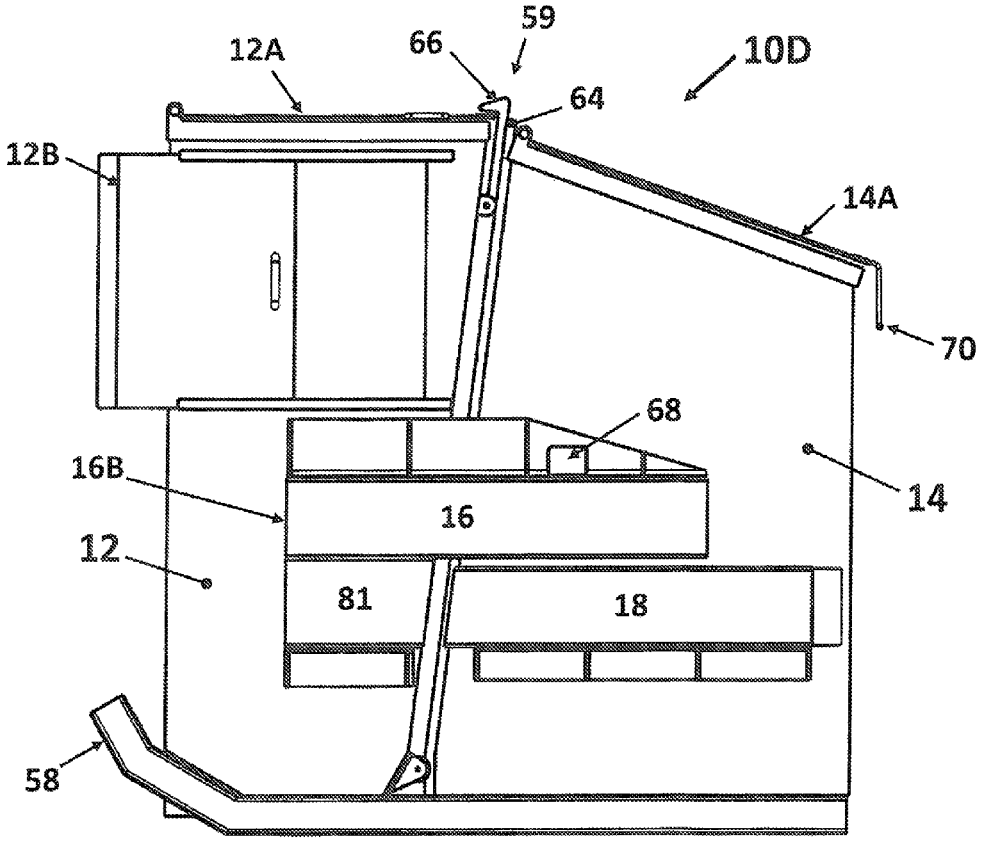
FIG. 11B is a side view of the device of FIG. 11A.
Figure 11C:
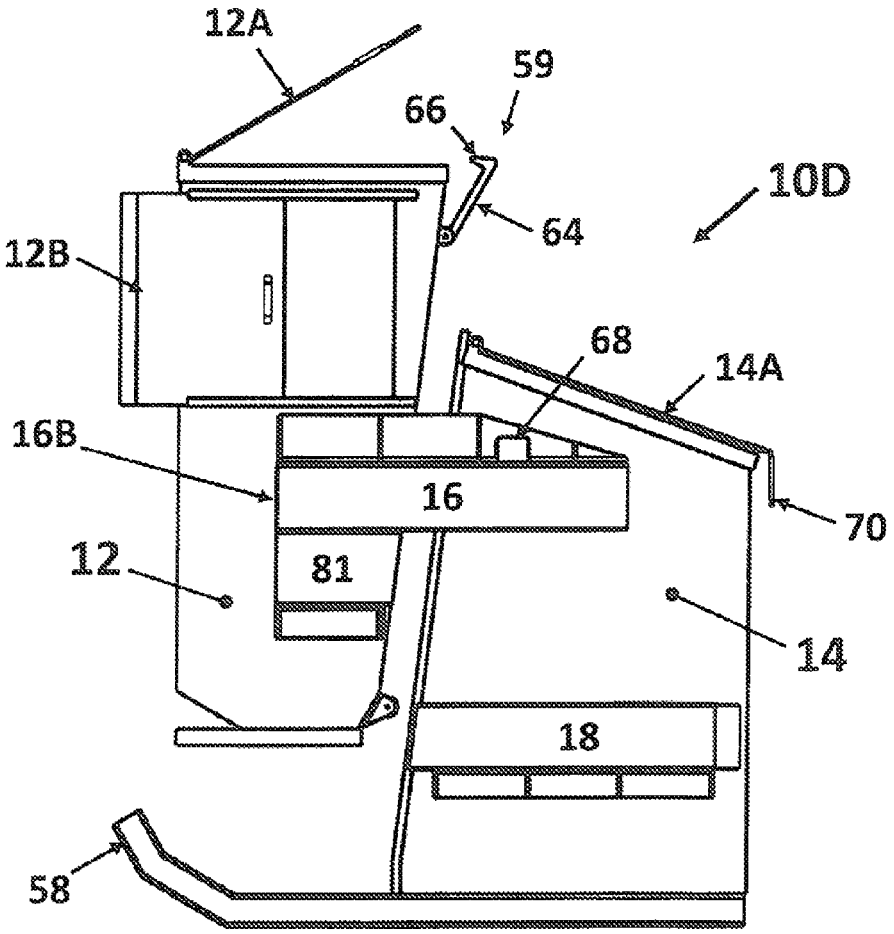
FIG. 11C is a side view of the device of FIG. 11A with the rear container raised.
Figure 12A:
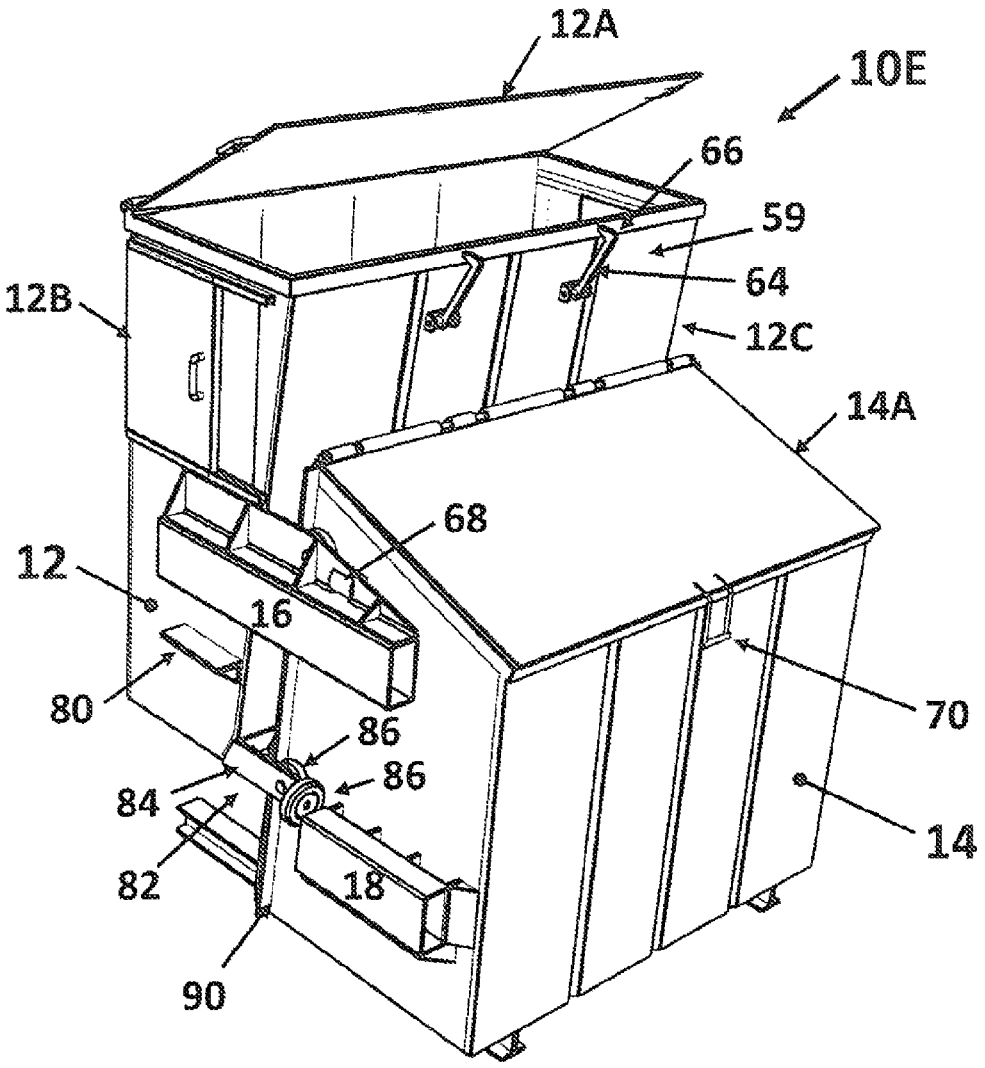
FIG. 12A is an elevated perspective view of another embodiment of the present invention.
Figure 12B:
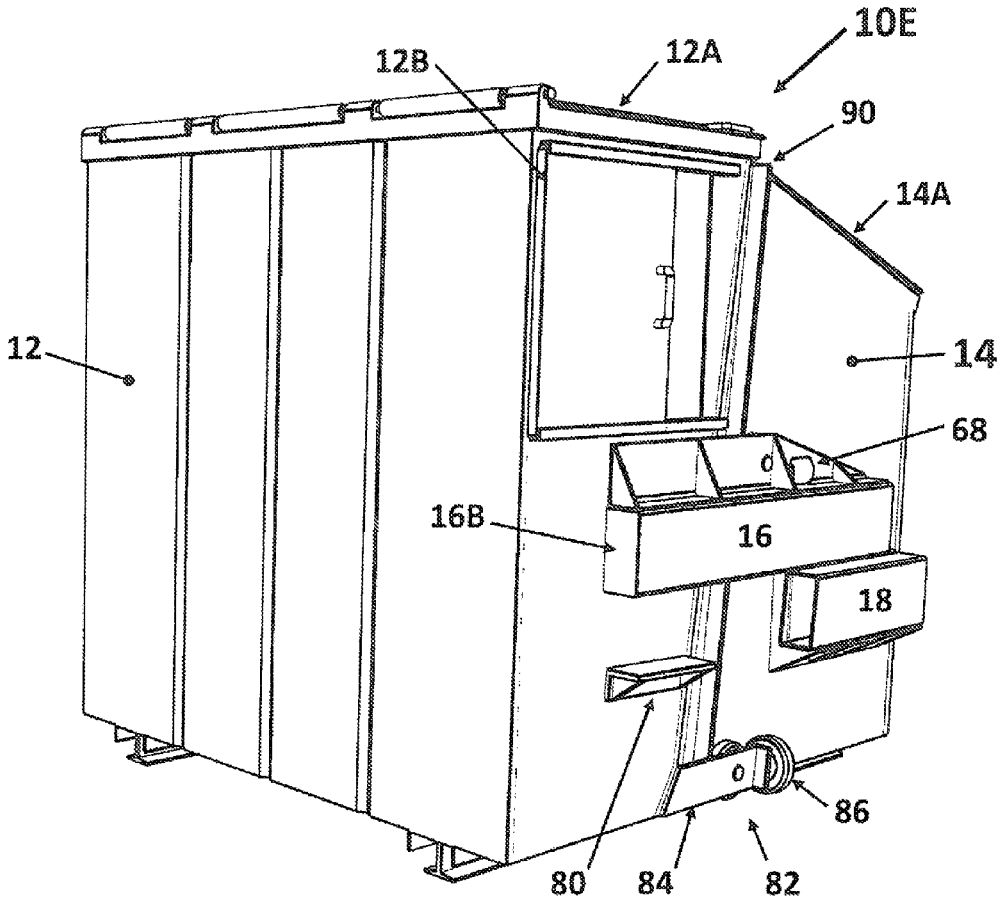
FIG. 12B is another elevated perspective view of the embodiment of FIG. 12A.
Figure 13:
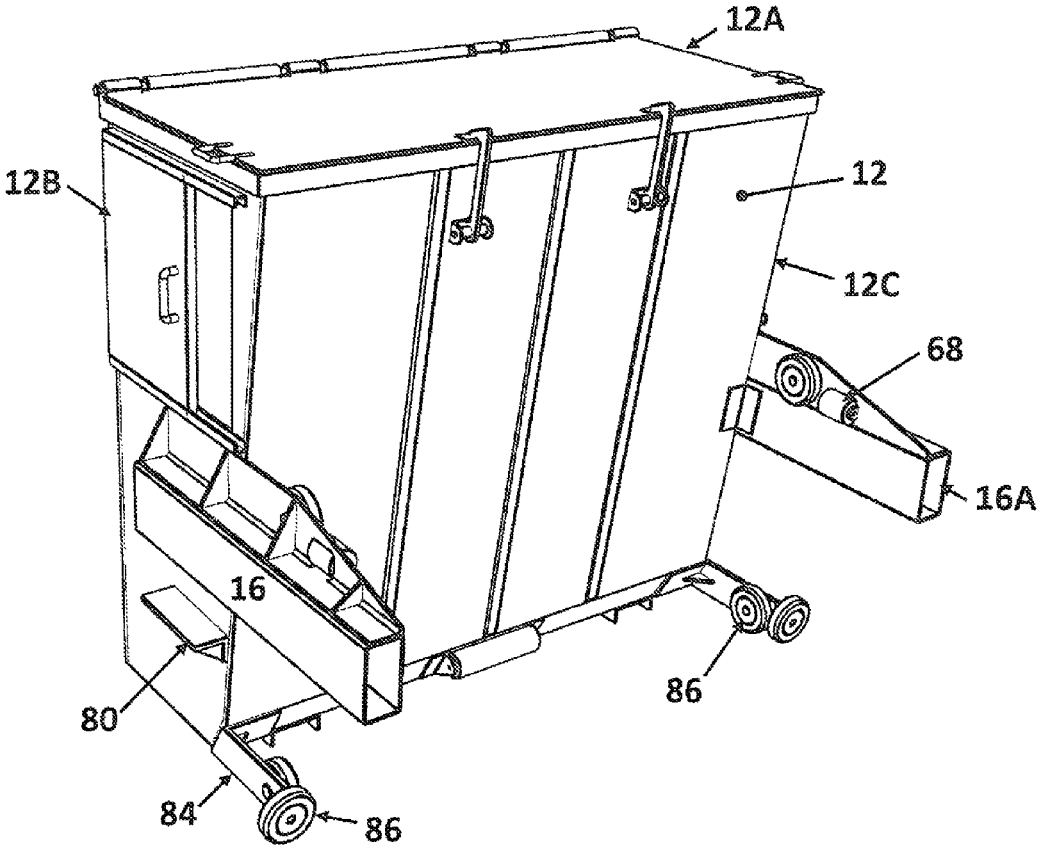
FIG. 13 is an elevated perspective view of the rear container of the device of FIG. 12A.
Figure 14:
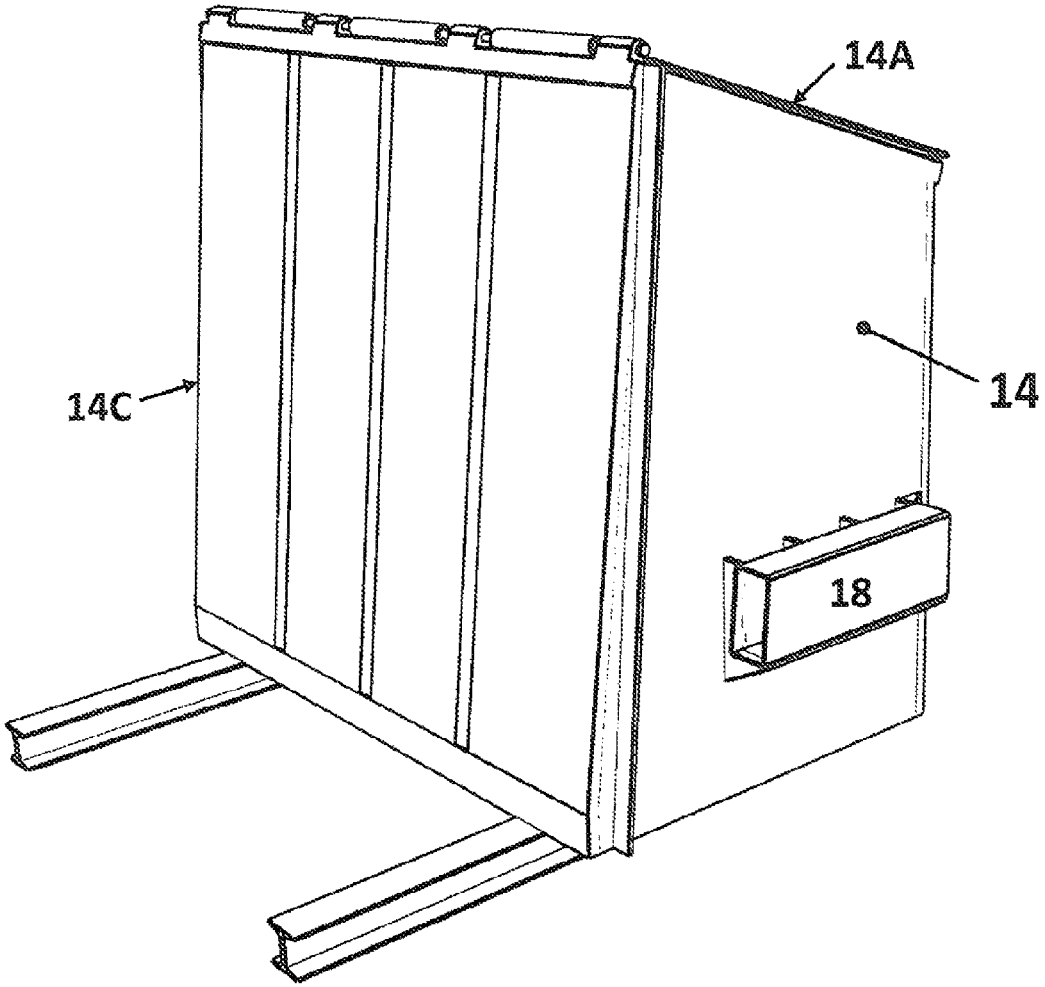
FIG. 14 is an elevated perspective view of the front container of the device of FIG. 12A.
Figure 15A:
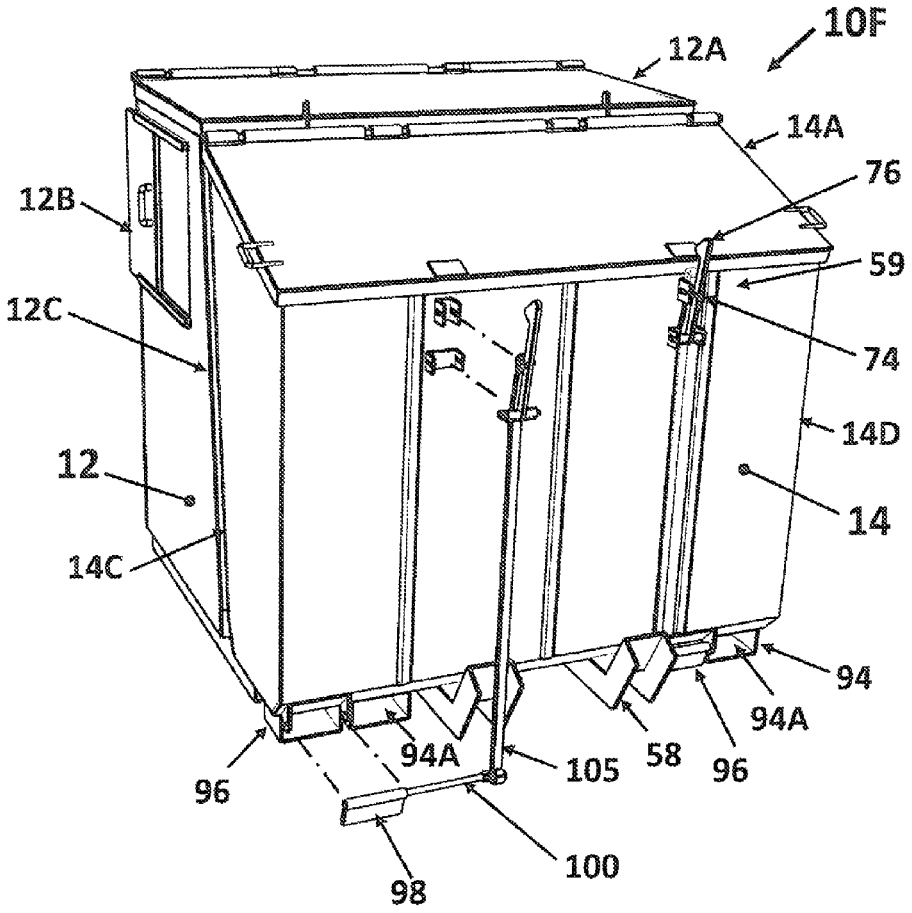
FIG. 15A is a perspective view of another embodiment of the device of the present invention.
Figure 15B:
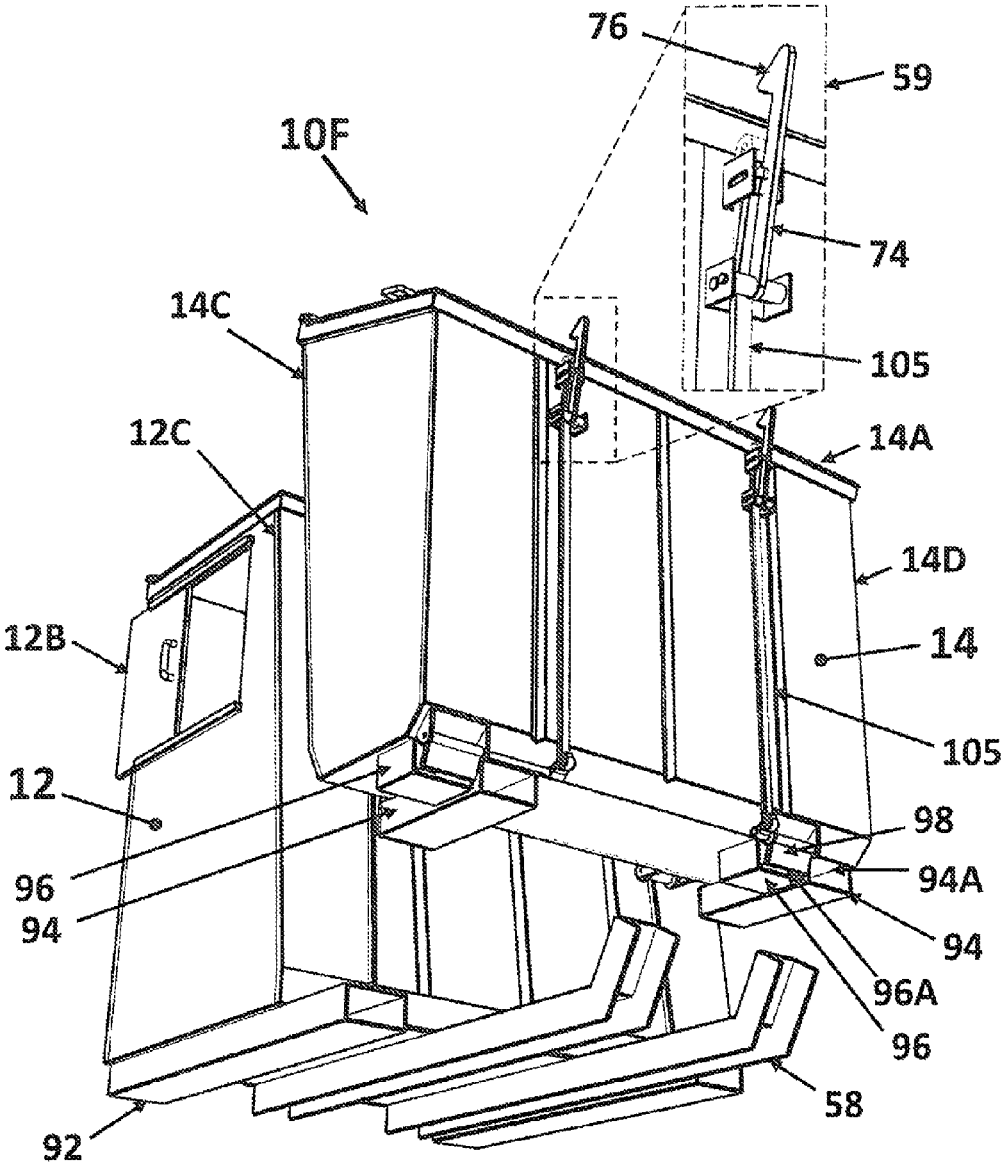
FIG. 15B is a bottom perspective view of the device of FIG. 15A with the front container raised.
Figure 15C:
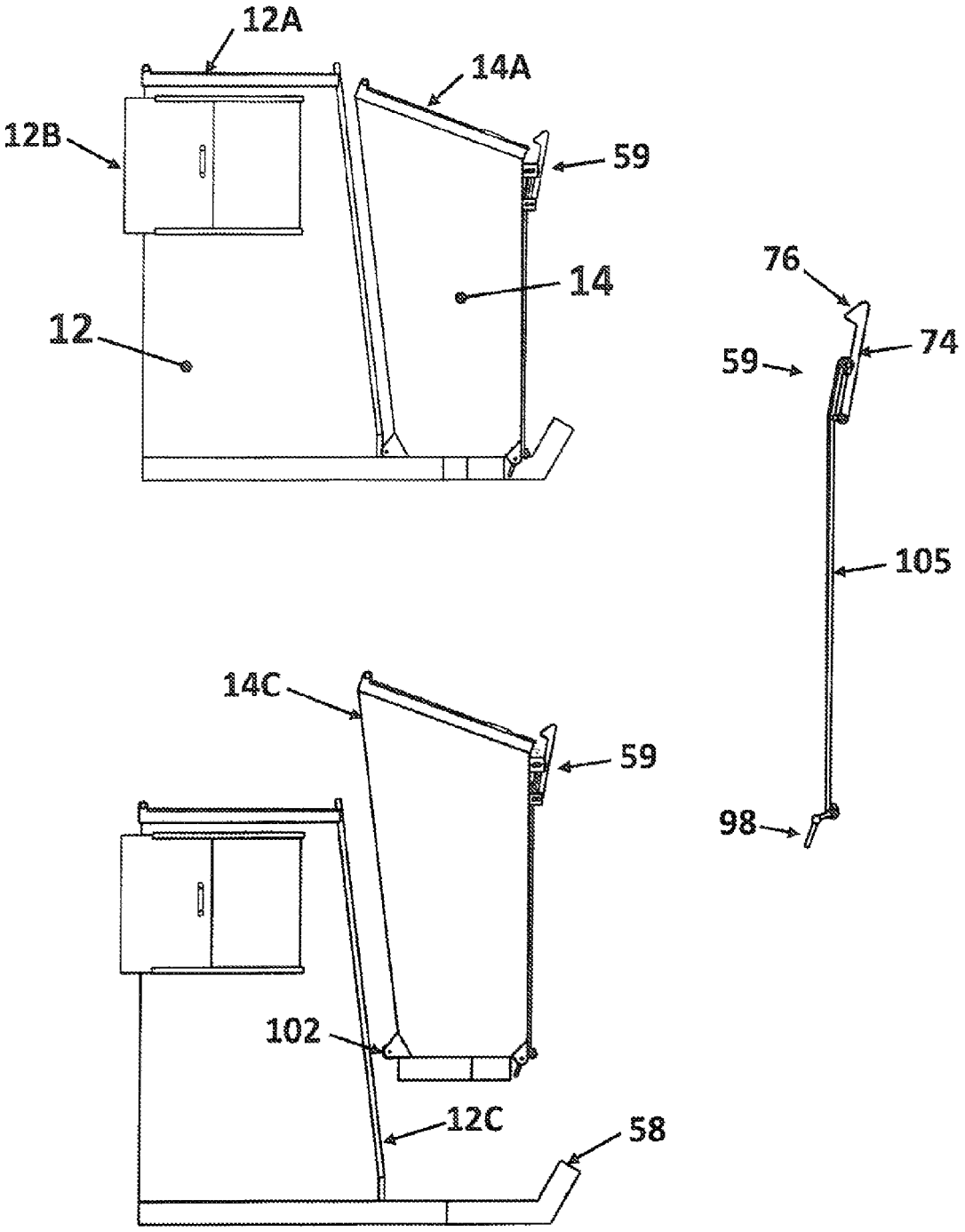
FIG. 15C is a side view of the device of FIG. 15A showing the front container in a lowered position and in a raised position.
Figure 15D:
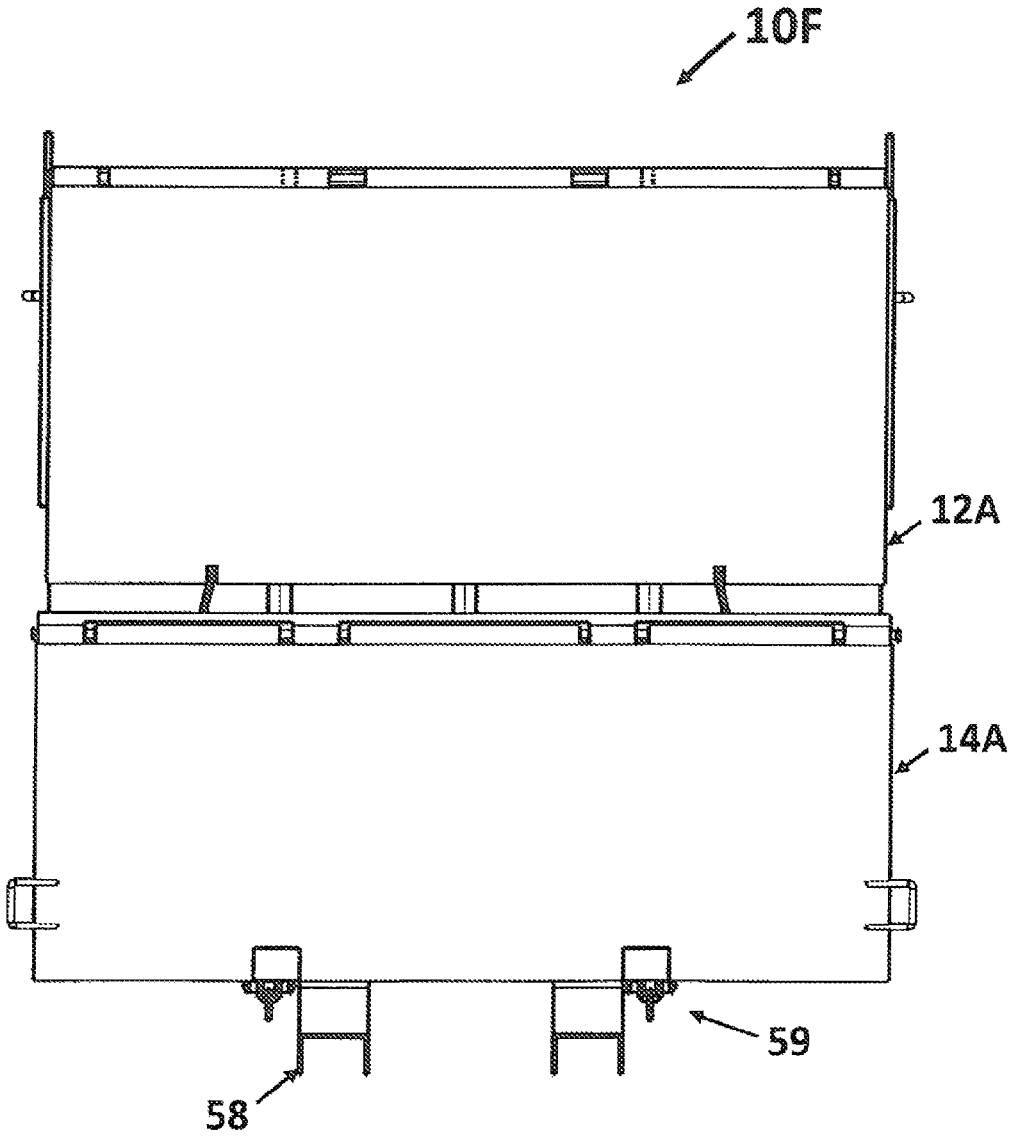
FIG. 15D is a top view of the device of FIG. 15A.
Figure 16A:
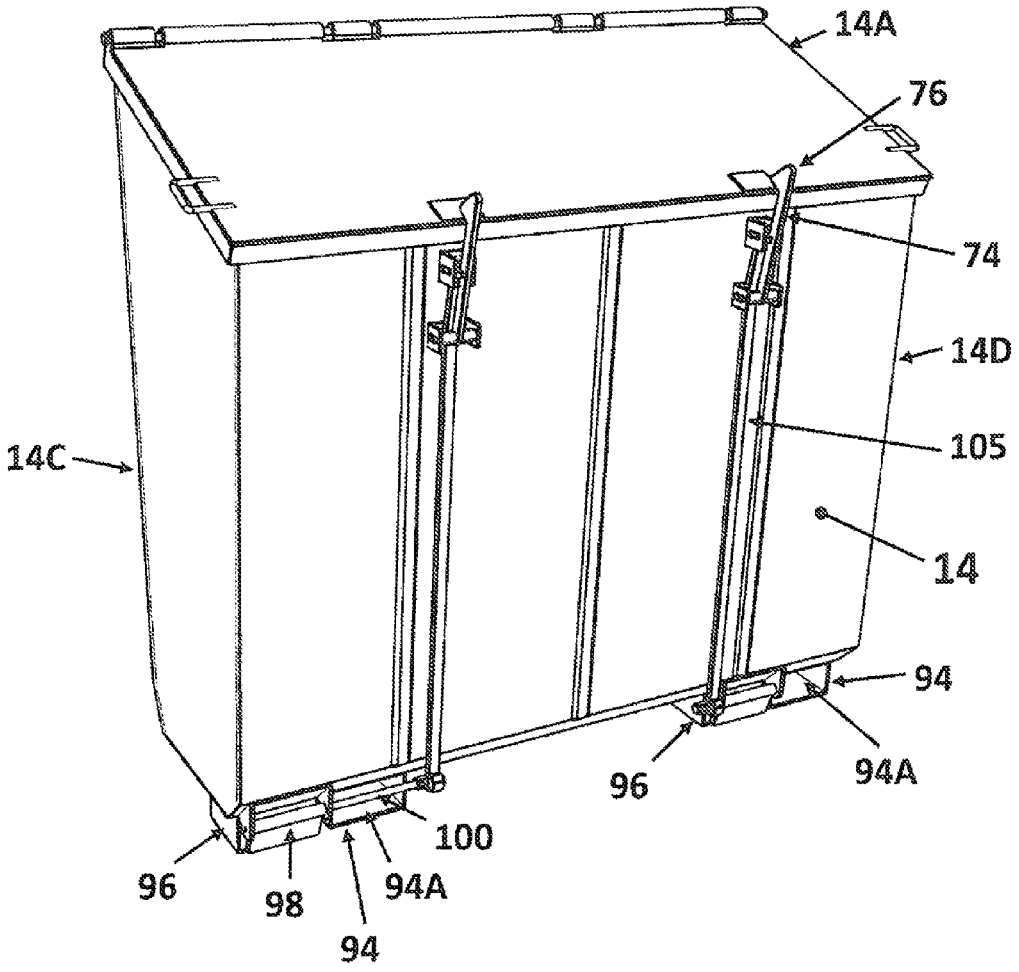
FIG. 16A is a perspective view of the front container of the device of FIG. 15A.
Figure 16B:
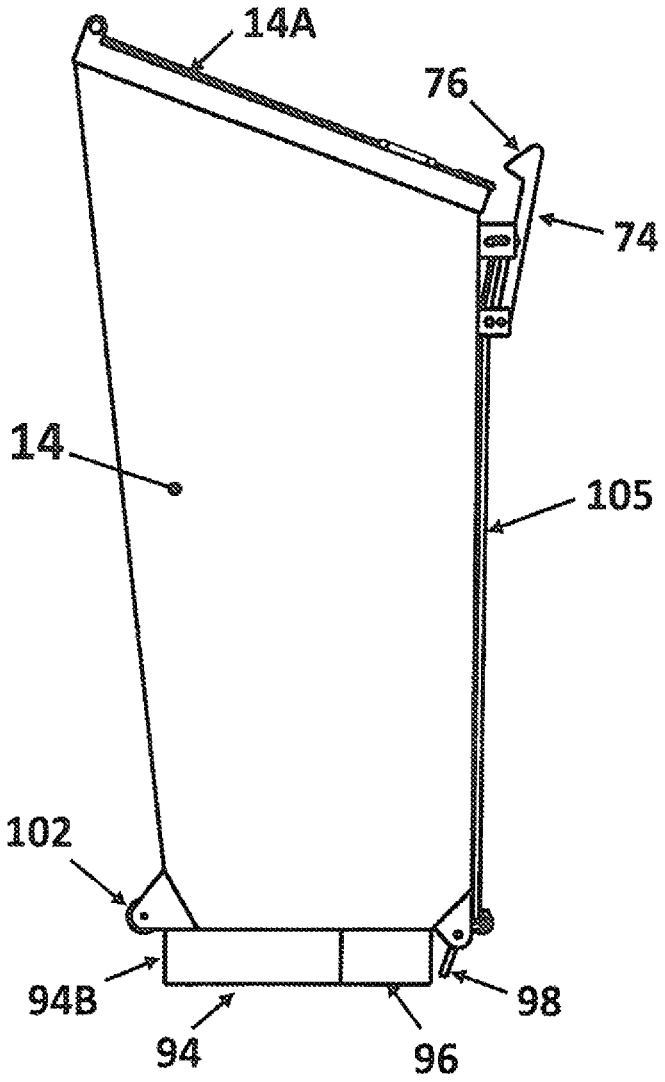
FIG. 16B is a side view of the front container of the device of FIG. 15A.
Figure 17A:
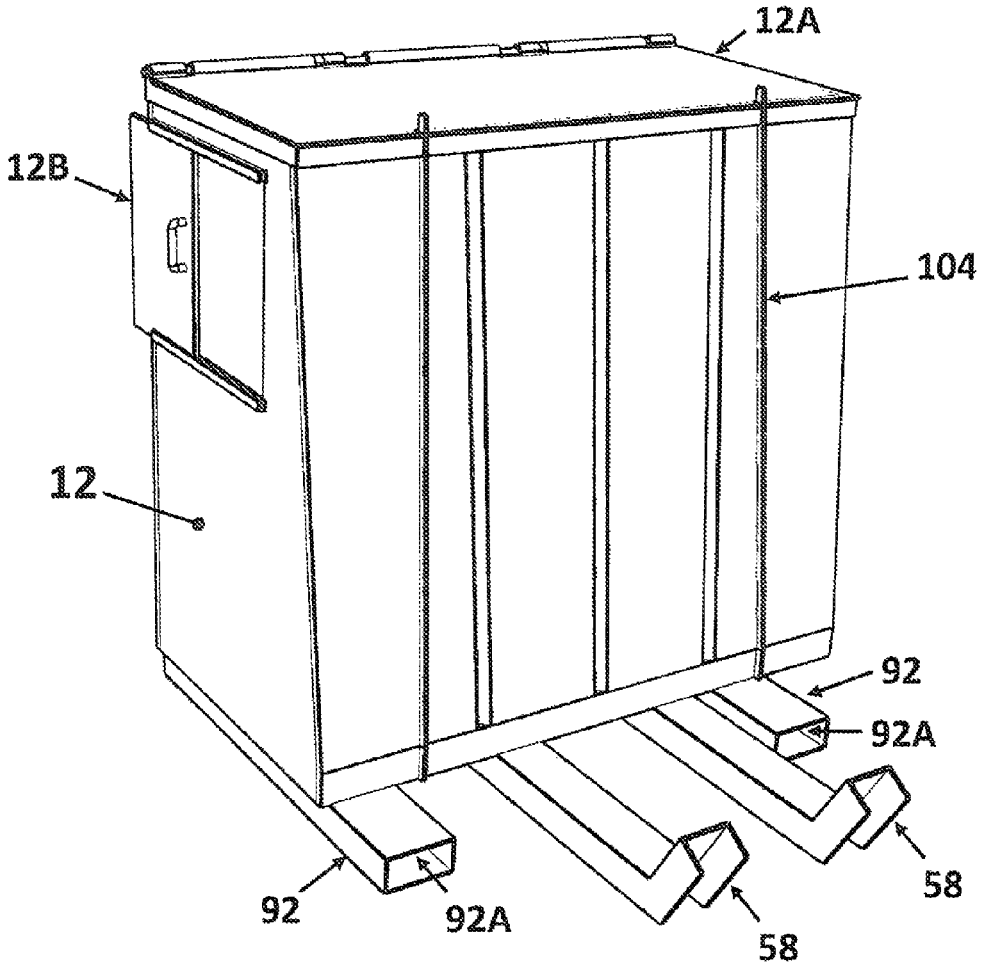
FIG. 17A is a perspective view of the rear container of the device of FIG. 15A.
Figure 17B:
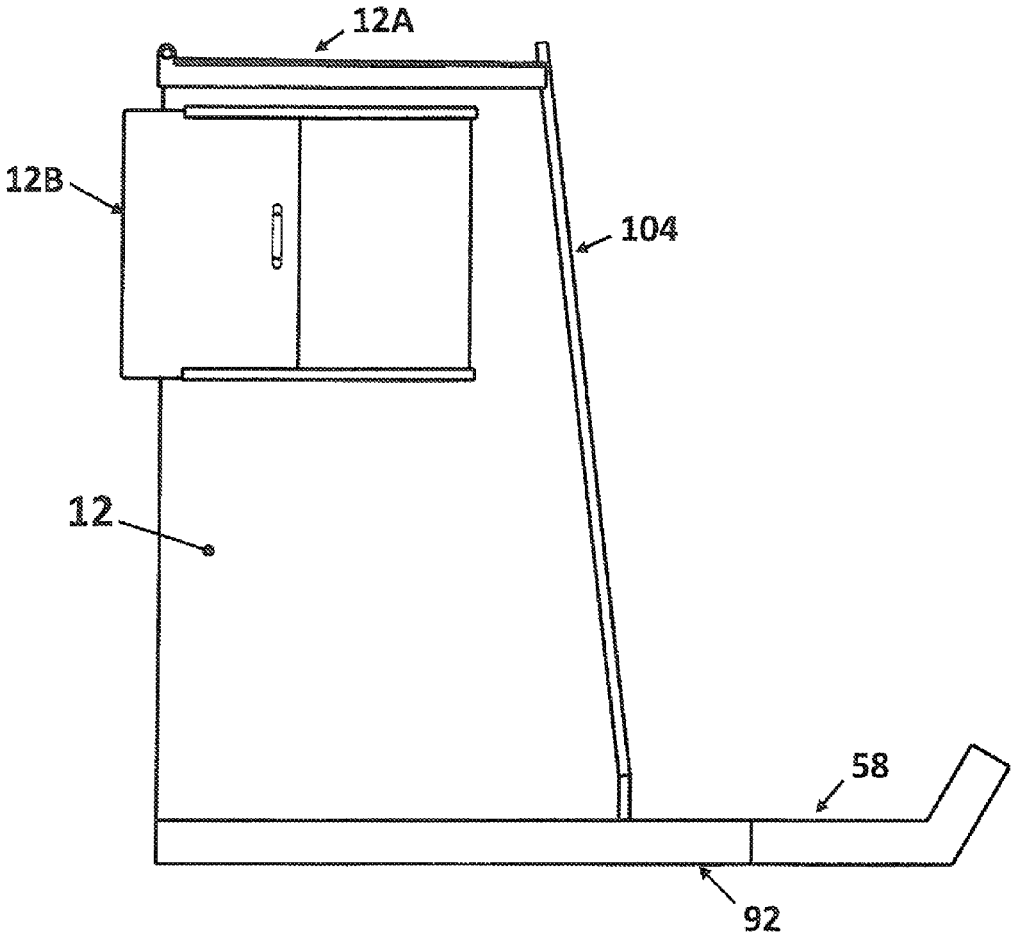
FIG. 17B is a side view of the rear container of the device of FIG. 15A.

Referring to FIGS. 11A and 11B, another embodiment of the device 10D is shown. The device 10D has a first container 12 and a second container 14. The first container 12 and second container 14 are generally made out of a sturdy metallic material such as steel or the like. However, other materials may be used without departing from the spirit and scope of the present invention.

The first container 12 and second container 14 may have lids 12A and 14A. A side door 12B may also be formed on the first container 12 and second container 14. In the present embodiment, the side door 12B is only formed in the first container 12. However, the side door 12B may be formed on one or both the first container 12 and or the second container 14.

In the present embodiment, the first container 12 has an angled front surface 12C and the second container 14 has an angled rear surface 14C. The front surface 12C and the rear surface 14C are approximately parallel to one another. The angle of the front surface 12C and the rear surface 14C allow the first container 12 to more easily be raised and lifted away from the second container 14. The angle of the front surface 12C and the rear surface 14C further makes it easier to better align the first and second containers 12 and 14 so that there is a minimal gap between the front surface 12C and the rear surface 14C of the first and second containers 12 and 14.

The first container 12 will have a pair of sleeves 16. The pair of sleeves 16 is generally made out of the same material as the first and second containers 12 and 14. An individual sleeve of the pair of sleeve members 16 is attached to a middle section of each side section of the first container 12. The pair of sleeves 16 will extend away from the first container 12. By extending the pair of sleeves 16 away from the first container 12, the pair of sleeves 16 forms a guide for the placement of the second container 14. The pair of sleeves 16 will have a hollow channeling 16A. The hollow channeling 16A allows for a standard fork lift-operated garbage truck to insert the fork through the pair of sleeves 16 to raise and empty the first container 12.

The second container 14 will have a pair of sleeves 18. The pair of sleeves 18 is generally made out of the same material as the first and second containers 12 and 14. An individual sleeve of the pair of sleeve members 18 is attached to a middle bottom section of each side section of the second container 14 and below the pair of sleeves 16 on the first container 12. The pair of sleeves 18 will have a hollow channeling 18A. The sleeves 18 generally run a length of the side section 14B.

Each sleeve 16 will have another sleeve 81 coupled to the underside of the sleeve 16. Below a first end of the sleeve 16 will be the sleeve 81. The sleeves 81 are in alignment with the second pair of sleeves 18 on the second container 14. The sleeve 81 is used in combination with sleeves 18 to simultaneous lift the two containers 12 and 14 without movement of the two containers 12 and 14 with respect to one another.

Since in this embodiment the device 10D enables simultaneous lifting of the two containers 12 and 14, device 10D will also include a locking device 59 to secure the lid 12A of the first container 12. This will allow the emptying of only second container 14 when simultaneous lifting of the two containers 12 and 14 for emptying. The first container 12 can still be lifted and emptied individually like in the previous embodiment.

In the present embodiment, the locking device 59 is a latch 64. The latch 64 is hingly coupled to the front surface 12C of the first container 12. The latch 64 has a hook 66 which will engage the lid 12A to lock the lid 12A when the first container 12 and second container 14 are positioned together. When the first container 12 and second container 14 are lifted together, the second container 14 will press the latch 64 forward so that the hook 66 will engage and lock the lid 12A. Thus, the lid 12A will remain closed when both the first container 12 and second container 14 are lifted together. When the forks of a standard dump truck pass through the pair of sleeves 16 to lift just the first container 12 slightly above the second container 14, the angle of the front surface of the first container causes the latch 64 to fall forward so that the hook disengages the lid 12A. This unlocks the lid 12A thereby allowing the lid 12A to open when the first container 12 is emptied.

In the present embodiment, rollers 68 are placed on the interior side of the sleeves 16. The rollers 68 are positioned on the section of the sleeves 16 that extend away from the first container 12. The rollers 68 are used to allow the first container 12 to more easily be lifted away from and realigned with the second container 14.

The second container 14 may also have a pair of support members 58 attached to its bottom for placement of the first container 12 upon during its resting position. The support members 58 are angled upwardly away from the second container 14 thereby providing an additional mechanism for aligning the first and second containers 12 and 14 and for preventing movement of the two containers 12 and 14 with respect to one another during simultaneous lifting of the two containers 12 and 14.

Referring now to FIGS. 12A-14, another embodiment of the device 10E will be disclosed. The device 10E still has a first container 12 and a second container 14. The first container 12 will be capable of being lifted individually from the second container 14 while also being capable of being lifted simultaneously with the second container 14.

The first container 12 will have a pair of sleeves 16 positioned in a like manner as in the previous embodiment. The pair of sleeves 16 enables lifting of the first container 12 by itself. The second container will still have a pair of sleeves 18 positioned in like manner as in the previous embodiment.

In the present embodiment, the first container 12 will also have a pair of locking plates 80. The locking plates 80 are attached to the side surfaces of the first container 12 and aligned with a bottom surface of the sleeves 18. The locking plates 80 keep the first container 12 from sliding up off of the second container 14 when both the first and second containers are lifted. When the forks of a standard dump truck pass through the sleeves 18, the bottom of the forks will engage the locking plates 80 preventing the first container 12 from sliding up off of the second container 14 when both the first and second containers are lifted.

Since in this embodiment the device 10E enables simultaneous lifting of the two containers 12 and 14, device 10E will also include a locking device 59 to secure the lid 12A of the first container 12. This will allow the emptying of only first container 12 when simultaneous lifting of the two containers 12 and 14 for emptying.

In this embodiment, a roller assembly 82 is attached to bottom corners of the front surface 12A of the first container 12. The roller assembly 82 has a pair of plate members 84 attached to the bottom corners of the first surface 12A. A set of rollers 86 is attached to the plate members 84. When the first container 12 is lowered into its resting position in proximity to the second container 14, the rollers 86 engage guide plates 90 and the side surfaces of the second container 14 thereby bringing the first container 12 in alignment with the second container 14.

Rollers 68 are placed on the interior side of the sleeves 16. The rollers 68 are positioned on the section of the sleeves 16 that extend away from the first container 12. The rollers 68 are used to allow the first container 12 to more easily be lifted away from and realigned with the second container 14.

Referring to FIGS. 15A-17B, another embodiment of the device 10F is shown. In this embodiment of the invention, the device 10F is lifted from the bottom. The device 10F has a first container 12 and a second container 14. The first container 12 and second container 14 are generally made out of a sturdy metallic material such as steel or the like. However, other materials may be used without departing from the spirit and scope of the present invention.

The first container 12 and second container 14 may have lids 12A and 14A. A side door 12B may also be formed on the first container 12 and second container 14. In the present embodiment, the side door 12B is only formed in the first container 12. However, the side door 12B may be formed on one or both the first container 12 and or the second container 14.

In the present embodiment, the first container 12 has an angled front surface 12C and the second container 14 has an angled rear surface 14C. The front surface 12C and the rear surface 14C are approximately parallel to one another. The angle of the front surface 12C and the rear surface 14C allow the second container 14 to more easily be raised and lifted away from the first container 12. The angle of the front surface 12C and the rear surface 14C further makes it easier to better align the first and second containers 12 and 14 so that there is a minimal gap between the front surface 12C and the rear surface 14C of the first and second containers 12 and 14.

The first container 12 will have a pair of sleeves 92. The pair of sleeves 92 is generally made out of the same material as the first and second containers 12 and 14. An individual sleeve of the pair of sleeve members 92 is attached to an outer edge on a bottom section of the first container 12. The pair of sleeves 92 will extend away from the first container 12. The pair of sleeves 92 will have a hollow channeling 92A. The hollow channeling 92A allows for existing fork lift-operated garbage trucks to insert the fork through the pair of sleeves 92.

The second container 14 will have a pair of sleeves 96. The pair of sleeves 96 is generally made out of the same material as the first and second containers 12 and 14. An individual sleeve of the pair of sleeve members 96 is attached to an outer edge on a bottom section of the second container 14. The pair of sleeves 96 will have a hollow channeling 96A. The sleeves 92 of the first container 12 are in alignment with the sleeves 96 on the second container 14 when the first container 12 and second container 14 are properly alignment. The sleeve 92 is used in combination with sleeves 96 to simultaneous lift the two containers 12 and 14 without movement of the two containers 12 and 14 with respect to one another.

The second container 14 will have a pair of sleeves 94. The pair of sleeves 94 is generally made out of the same material as the first and second containers 12 and 14. An individual sleeve of the pair of sleeve members 94 is attached to the bottom section of the second container 14 and next to a sleeve 96. In the present embodiment, the pair of sleeve members 94 is positioned on the bottom section of the second container 14 and adjacent to and inwardly from the sleeves 96. The pair of sleeves 94 will have a hollow channeling 94A. The length of each of the pair of sleeves 94 generally will not exceed the length of the second container 14. An end cap 94B is generally placed at the end of each sleeve 94. The sleeves 94 are used to lift the second container 14 up and away from the first container 12 to individually empty the second container 14.

Since in this embodiment the device 10F enables simultaneous lifting of the two containers 12 and 14, device 10F will also include a locking device 59 to secure the lid 12A of the first container 12. This will allow the emptying of only second container 14 when simultaneous lifting of the two containers 12 and 14 for emptying. The first container 12 can still be lifted and emptied individually like in the previous embodiment.

In the present embodiment, the locking mechanism 59 has one or more rod members 74 kingly coupled to a top area of the front surface 14D of the second container 14. On one end of each rod member 74 is a hook 76. The hook 76 engages the lid 14A when the rod member 74 is in a first position thereby locking the lid 14. When the rod member 74 is placed in a second position, the hook 76 disengages from the lid 14A allowing one to lift the lid 14A.

Attached to a second end of the rod member 74 is a plate 98. The plate 98 is positioned in front of the sleeves 94. When the forks of the dump truck push the plate 98, it rotates upwards. A rod 100 (or chain, belt, etc.) is attached to the shaft of the plate 98. When the plate rotates upwards, it pulls the rod 100, which in turn, pulls the hook closed, locking the lid 14A of the second container 14.

When emptying just the second container 14, the truck forks slide into the sleeves 94. The locking mechanism 59 will not be engaged so the lid 14A is free to swing open when emptied. The sleeves 94 have end caps 94B on the back side so that the forks cannot protrude out the back of the second container 14 and so that the second container 14 doesn't slide down the forks as its being emptied. Without this feature, the second container 14 would slide down the forks and the forks would hit the first container 12 when the second container 14 was lowered back into place.

The first container 12 may also have a pair of support members 58 attached to its bottom for placement of the second container 14 upon during its resting position. The support members 58 are angled upwardly away from the second container 14 thereby providing an additional mechanism for aligning the first and second containers 12 and 14 and for preventing movement of the two containers 12 and 14 with respect to one another during simultaneous lifting of the two containers 12 and 14.

In the present embodiment, a set of rollers 102 may be coupled to a rear surface 14C of the second container 14. The rollers 102 are used to help lift the second container 14 up and away from the first container 12. The rollers 102 may be used with guide rails 104 to properly align the first and second containers 12 and 14 respectively.

While embodiments of the disclosure have been described in terms of various specific embodiments, those skilled in the art will recognize that the embodiments of the disclosure can be practiced with modifications within the spirit and scope of the claims.

What is claimed is:

1. A device for waste collection comprising:

a first container;

a second container;

a first pair of lifting sleeves coupled to side surfaces of the first container for lifting the first container; and a second pair of lifting sleeves coupled to side surfaces of the second container and positioned below the first pair of lifting sleeves for lifting the second container;

wherein the first pair of lifting sleeves extend away from the first container, the second container positioned between the first pair of lifting sleeves.

2. A device for waste collection in accordance with claim 1 wherein a front surface of the first container and a rear surface of the second container are angled and form mating surfaces.

3. A device for waste collection in accordance with claim 1 further comprising an alignment mechanism coupled to the first container and the second container for ensuring the alignment of the first container with the second container.

4. A device for waste collection in accordance with claim 1 further comprising at least one roller attached to an interior surface of each of the second pair of lifting sleeves.

5. A device for waste collection in accordance with claim 1 further comprising a door formed on at least one of the side surfaces of the first container or the side surfaces of the second container.

6. A device for waste collection in accordance with claim 1 further comprising a at least one roller positioned on a front surface of the first container.

7. A device for waste collection in accordance with claim 1 further comprising a handle attached to a lid of the second container.

* * * * *